US007060926B2

(12) United States Patent
Edmonds

(10) Patent No.: US 7,060,926 B2
(45) Date of Patent: Jun. 13, 2006

(54) METHOD AND SYSTEM FOR SINGLE PASS LETTER AND FLAT PROCESSING

(75) Inventor: Dean S. Edmonds, Great Falls, VA (US)

(73) Assignee: United States Postal Service, Washington, DC (US)

( * ) Notice: Subject to any disclaimer, the term of this patent is extended or adjusted under 35 U.S.C. 154(b) by 45 days.

(21) Appl. No.: 10/312,402

(22) PCT Filed: Jun. 26, 2001

(86) PCT No.: PCT/US01/20265

§ 371 (c)(1),
(2), (4) Date: Dec. 26, 2002

(87) PCT Pub. No.: WO02/00362

PCT Pub. Date: Jan. 3, 2002

(65) Prior Publication Data

US 2003/0208298 A1 Nov. 6, 2003

Related U.S. Application Data

(60) Provisional application No. 60/255,400, filed on Dec. 15, 2000, provisional application No. 60/214,255, filed on Jun. 26, 2000.

(51) Int. Cl.
*B07C 5/00* (2006.01)

(52) U.S. Cl. ..... 209/584; 209/900; 700/224

(58) Field of Classification Search ..... 209/583, 209/584, 900, 939; 53/147, 203; 700/223, 700/224

See application file for complete search history.

(56) References Cited

U.S. PATENT DOCUMENTS

| | | | | |
|---|---|---|---|---|
| 5,538,138 | A * | 7/1996 | Reich | 209/3.3 |
| 5,910,998 | A * | 6/1999 | Yui | 382/101 |
| 6,219,647 | B1 | 4/2001 | Hidding et al. | |
| 6,219,994 | B1 * | 4/2001 | Taniguchi | 53/147 |
| 6,520,342 | B1 * | 2/2003 | Dumke et al. | 209/539 |
| 2004/0065595 | A1 * | 4/2004 | Hanson | 209/584 |
| 2004/0211709 | A1 * | 10/2004 | Hanson et al. | 209/584 |

FOREIGN PATENT DOCUMENTS

FR 2676941 12/1992

OTHER PUBLICATIONS

International Search Report, dated Jan. 2, 2002, from PCT/US01/20265 (4 pages).

* cited by examiner

*Primary Examiner*—Joseph Rodriguez
(74) *Attorney, Agent, or Firm*—Finnegan,, Henderson, Farabow, Garrett & Dunner, L.L.P.

(57) ABSTRACT

The sorting and packaging system comprises an induction and scanning system, a single pass sorting and packaging system for automatically sorting and packaging a plurality of mailpieces based on a single scan by the induction and sorting system, and a control unit connected to and controlling the induction and scanning system and the single pass sorting and packaging system. The single pass sorting and packaging system comprises at least one cell rack, at least one packaging system, and at least one delivery system. The cell rack is connected to the induction and scanning system by a transport sorting system. The cell rack comprises a plurality of cells and a purging system. The packaging system is connected to the cell rack and comprises a transport packaging system and a packaging unit. The delivery system is connected to the packaging system.

93 Claims, 14 Drawing Sheets

METHOD AND SYSTEM FOR SINGLE PASS LETTER AND FLAT PROCESSING

RELATED APPLICATIONS

The present application is related to and claims the priority of U.S. Provisional Application No. 60/214,255, filed Jun. 26, 2000, entitled Apparatus and Methods for Mail Single Pass Delivery Point Sequence and Sorter Packaging, and U.S. Provisional Application No. 60/255,400, filed Dec. 15, 2000, entitled Method for Single Pass Letter and Flat Processing, both in the name of Dean S. Edmonds. The disclosures of both of these U.S. Provisional Applications are hereby expressly and fully incorporated by reference.

FIELD OF THE INVENTION

The present invention relates generally to an automated method and system for sorting labeled objects, such as addressed or bar-coded mailpieces. In particular, the present invention relates to an automated method and system for sorting mail at a postal processing facility for delivery to other postal processing facilities and to local post offices serviced by the processing facility.

BACKGROUND OF THE INVENTION

Presently, the sorting process for all types of mail is at least partially manual. All mail is separated categorically at incoming loading docks at processing facilities and each category follows a similar sorting process with different levels of manual involvement. Categories of mail include, among others: stamped letters; metered letters; flats, e.g., magazines and brochures, which are larger and/or thicker than a typical envelope; bulk mail and parcels, e.g., packages, boxes and other larger-sized mailpieces; circulars, e.g. flyers, such as advertisements from businesses like supermarkets that are distributed to all postal patrons and therefore do not need to be scanned; accountable mail that requires a signature for delivery, e.g., certified mail, express (overnight) mail, return receipt mail, and collection on delivery (C.O.D.) mail; first class mail, i.e. the typical stamped letter; second-class mail; and third class mail. For example, although flats and letters follow similar sorting processes, flat sorting currently is less automated than letter sorting. For exemplary purposes, the sorting process presently used is described herein for letters, but it is to be understood that the process is similar, albeit more manual, for other types of mail.

In the present letter sorting process, letters are fed into an Automated Facer Canceller System ("AFCS") that "faces" the letters (positions them so that addresses and postage face in the same direction for subsequent scanning) and checks for and cancels postage. At the output of the AFCS, the letters accumulate in bins. The bins are manually unloaded and transferred to letter trays. The trays are then loaded into wheeled all-purpose containers ("APCs") and transported by motorized trucks or pushed by laborers to the next sorting machine.

The letters from the AFCS operation as well as letters received from other processing facilities are manually loaded in the Optical Character Reader ("OCR") system for processing. The reader component of the OCR reads the address on the letter and determines if it has a usable bar code. If no barcode is present, the written address is read and resolved and the OCR "sprays," or prints, a barcode on the envelope identifying the postal code, carrier route, and other information used in sorting. The OCR then roughly sorts the mail by areas or regions into bins. If the OCR cannot read the address or if the barcode is incorrect, the letter is rejected by the OCR and is sorted manually.

Because of the limited number of bins on an OCR sorting machine, a sorting scheme assigns bins based on previously experienced mail volumes for an area or region. For example, for a processing facility located in Northern Virginia, areas such as Washington, D.C.; Arlington, Va.; Alexandria, Va.; Southern Maryland; New York, N.Y.; San Francisco, Calif.; Los Angeles, Calif.; Chicago, Ill.; New England; the Southeast; the Midwest; the Northwest; and the Southwest each might have a designated bin at this stage based on the volume of mail sent out of Northern Virginia destined for each of these areas. The letters in these bins are manually removed and placed in letter trays. In some cases, the letter trays are ready to be manually transported to a staging area for later transport to another mail processing facility. In other cases, the mail is placed in letter trays that are manually transported and loaded in Delivery Bar Code Sorters ("DBCSs") for processing to delivery sequence order by zip code and carrier route. The remaining letters are placed in letter trays that are staged to be run through the OCR operation a second time to further sort the mail.

After all the letters received by a predetermined cutoff time have been run through OCRs the first time, i.e., a "first pass," the OCRs are shut down and programmed with a new, refined sorting logic to further sort the letters into smaller areas or regions, i.e., a "second pass." Letters in the bins are manually removed and placed in letter trays. These letter trays are either transported to a staging area for transport to another processing plant, staged for a second pass through an OCR operation, or staged for transport to a DBCS machine for processing to delivery sequence order based on zip code. Because all OCR operations are shut down and all OCRs are reprogrammed at the same time with the same sort logic or sort schemes, letters may be further sorted (a "second pass") on the same OCR or a different OCR as the first pass. Letter trays of first pass OCR-sorted letters requiring a second pass are manually reloaded onto the OCR, which reads the bar codes again and sends the letters to bins corresponding to particular zip codes, cities, towns, states, areas, regions, etc., where bins are assigned to an area based on the volume of letters anticipated for each of the locations.

Following the second pass by the OCR, the mail is manually removed from the bins and placed in trays. Again, some of the trays are ready to be manually transported to a staging area for transport to another processing facility where they will be further sorted. Many letters are destined for local post offices serviced by the processing facility, and these trays are manually placed in carts and manually transported by motorized trucks or push carts to Delivery Bar Code Sorters ("DBCS") located within the same processing facility, or to staging areas for transport to other local facilities with DBCSs, such as local post offices.

A DBCS machine, using two sequential processing operations, sorts letter mail to carrier delivery sequence order. The DBCS "first pass" sorting operation sorts the mail for a particular zip code into "stop" order. For example, all of the first stops, i.e., first delivery points, for all routes in that zip code go to bin one. Similarly all second stops for all routes in that zip code go to bin two, and so on, where each carrier stop is assigned a bin. All the mail for a particular zip code is collected and run, thereby putting all mail for that zip code in a bin corresponding to the stop number. In short, if the mail from DBCS bin 10 was checked, it would be mail for all carrier routes in that zip code that corresponded to the tenth stop on the carriers' routes. Once all the mail for that zip code is processed or a predetermined cut-off time has been reached, the DBCS is shut down and the mail is manually removed from the bins and placed in letter trays corresponding to the bins from which it was removed.

For a zip code receiving a large volume of mail, the DBCS is assigned to process a particular zip code. If the mail volume for a particular zip code is low compared to machine processing capacity, one or more additional zip codes may be assigned to a particular DBCS machine for concurrent processing. If multiple zip codes are processed on one machine, the process for the first pass remains the same, and the mail is sorted by delivery sequence, stop, and order, regardless of the zip code or carrier route.

After the first pass on the DBCS has been completed, the machine is reprogrammed to sort the mail by carrier route in a second pass. If multiple zip codes are to be run on the machine, the mail is sorted by both zip code and carrier route. The second pass requires that the DBCS be manually fed mail in delivery stop order. The DBCS assigns bins to carrier routes for the second pass. The operator feeds the machine all first stop mail from the bin of stop one mail for all carrier routes (and appropriate zip codes if multiple zip codes are assigned to the machine). The DBCS sorts the first stop mail to the correct zip code and carrier route. After all the first stop mail has been fed, the operator then feeds all second stop mail from the bin of second stop mail. The DBCS then sorts the second stop mail to the correct carrier route (and zip code, if applicable). Next, the third stop mail is fed and sorted, and so on, until the last stop is sorted for the route with the most stops for the particular zip code(s) and carrier routes being processed. The result is that in a particular bin, which correlates to a particular carrier route, the mail for that route is in delivery sequence order starting with stop one and ending with the last stop on the route (unless the bin fills up prior to the last stop).

As a bin fills up, the operator removes the mail from that bin and places it in a letter tray assigned to that bin's zip code and carrier route. The first letter tray for a particular carrier route is identified as tray 1. As mail continues to be sorted to that carrier route, the operator continues to remove mail from the bin, i.e., "sweep the bin," and place it in the letter tray. When letter tray 1 for a particular route is filled, another tray is selected and assigned the same route number and a tray sequence number of 2. Additional trays are assigned in sequence until all the mail for a particular route has been sorted. This process is the same for each carrier route. Should the operator not be paying attention and fail to empty a full bin, the DBCS will stop processing when any bin is 80% full.

These letter trays are manually collected, put in tray containers, and pushed or driven to a staging area in which other types of mail that has undergone a similar sorting process also is staged. The sorted mail is then manually loaded into vehicles and transported to local post offices, where it is unloaded and picked up by the carrier for delivery. If the DBCS is located at a local post office instead of the postal processing facility, the trays are not transported but are simply staged for carrier pickup.

In contrast to letter mail sorted to delivery sequence order at the postal processing facility, clerks sort parcels, flats, and other mail manually by carrier route at local post offices. Typically, at the local post office in a particular zip code or codes (and not the postal processing facility containing OCRs, DBCSs, etc.), parcels are manually sorted into hampers by carrier route, while flats and other manual mail are manually sorted by carriers into a "carrier route case" by carrier route in delivery sequence order. The case is laid out with cells in delivery sequence order into which the carrier sorts, or "cases," the individual mail pieces. After the carrier has sorted or cased all his mail for the route, he empties the case in delivery order. This is done by removing the mail from the cell representing the first stop, next removing the mail from the second stop cell, and so on, until all the manual mail has been removed. The removed mail is placed in a letter tray with the address facing forward, thereby remaining in delivery sequence. The result of this removal of the mail from the case, called a "case pull down," is trays of manually sorted mail organized in delivery sequence order for a particular route. These trays of manually sequenced delivery order mail resemble the trays of mail resulting from the DBCS operation.

Before starting street delivery operations, the carrier loads his truck. The carrier loads the parcels the clerk sorted to his route. There is no defined delivery sequence ordering of parcels and packages, but the carrier may choose to place the parcels and packages in some sort of delivery order. The carrier then loads the tray(s) of flats and other mail he manually sorted in the case to delivery sequence order and the trays of DBCS-processed mail from the cart. Thus there are two sets of trays with mail in delivery sequence order: the DBCS-sorted mail and the manually-sorted mail. The carrier must check each set of sequentially sorted mail for each address. In addition, if there are parcels or advertisement mailers or circulars (e.g., supermarket flyers that are not addressed to a particular person, but are delivered to all addresses on that particular route), the carrier must combine them before delivery. The carrier also has an accountable mail tray, which contains mail that requires a signature or other receiver action, such as certified, return receipt, collection on delivery, delivery confirmation, and registered mail. The carrier must identify these pieces and combine them before delivery. In short, the carrier may have to combine mail from up to five different mail streams for a delivery: DBCS sorted mail; manually sorted mail; parcels; advertisement circulars; and accountable mail.

OCR and DBCS operations are conducted at different times of the day based on class and service of mail. Because the time constraints for delivering third class mail, bulk mail, flyers, advertisement, etc. are not as strict as those for first class mail, third class mail is sorted during the morning and afternoon hours.

Typically first class mail received at a processing facility (the "A facility") from local post offices, mailboxes, etc. is sorted by zip codes and regions on OCR machines from about 7 p.m. until approximately midnight. The midnight cut-off is critical for mail dispatched to other processing facilities within the overnight delivery territory (the "B facilities"). Mail received at the A facility from the B facilities is then run on an OCR and sorted by zip code between midnight and 2:30 a.m. At this point, mail destined for local delivery that was initially processed by the A facility or originated from the B facilities is staged for a first DBCS sort. This next step, the first pass of DBCS processing of mail, starts approximately 2:30 a.m. with a first pass cut-off time of approximately 4:30 a.m. After that cut-off time, no additional mail can be machine-processed to a particular zip code for that delivery day. The second pass on the DBCS follows to sort mail to delivery sequence order, and the sorting process is completed in time to meet dispatch to the delivery unit, which is anytime between 6:30 and 8:00 a.m. These machines are used to do other mail processing activities and to process other classes of mail at other times.

Sorting would be more efficient and mail throughput would be increased if an automated sorting process using machines linked in a sequential processing order and conducting the sorting scheme from start to finish replaced the present batch processing process. Batch processing requires a machine or groups of machines to perform the same portion of the sorting scheme simultaneously. Thus, all mail is read in a first pass, all machines are shut down and reprogrammed, and the mail is run a second time. Because of this protocol, present methods of sorting also require cut-off times, after which newly received mail must wait until the following day to be processed. In other words, if at 9 p.m. mail is being run through a second pass, new mail received and in need of the first pass cannot be run until the next day.

Automated sequential processing overcomes many of these drawbacks. Cut-off times are eliminated, as are machine shut downs, manual mail purgings, and system sort logic reprogrammings. In addition, all classes of mail capable of being sorted on the system are processed together, i.e., commingled, such as first class mail, circulars, boxes of checks from banks and other small parcels, and bulk mail, without a resultant delay in the delivery of first class mail. Due to the linkage between systems or components, the single pass sequential processing approach also eliminates the need for loading and transporting letter trays, thereby reducing labor and the need to store mail in between various stages of the sorting scheme.

SUMMARY OF THE INVENTION

A sorting and packaging system comprises an induction and scanning system, a single pass sorting and packaging system for automatically sorting a plurality of mailpieces based on a single scan by the induction and sorting system, and a control unit connected to and controlling the induction and scanning system and the single pass sorting and packaging system. The single pass sorting and packaging system comprises at least one cell rack, at least one packaging system, and at least one delivery system. The cell rack is connected to the induction and scanning system by a transport sorting system. The cell rack comprises a plurality of cells and a purging system. The packaging system is connected to the cell rack and comprises a transport packaging system and a packaging unit. The delivery system is connected to the packaging system.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate the various features and aspects of the method and apparatus for alphanumeric recognition and, together with the description, serve to explain its advantages and principles.

In the drawings.

DETAILED DESCRIPTION

Reference will now be made in detail to an implementation of the present invention as illustrated in the accompanying drawings. Wherever possible, the same reference numbers will be used throughout the drawings to refer to the same or like parts.

Sorting and Packaging System

Figure 1:
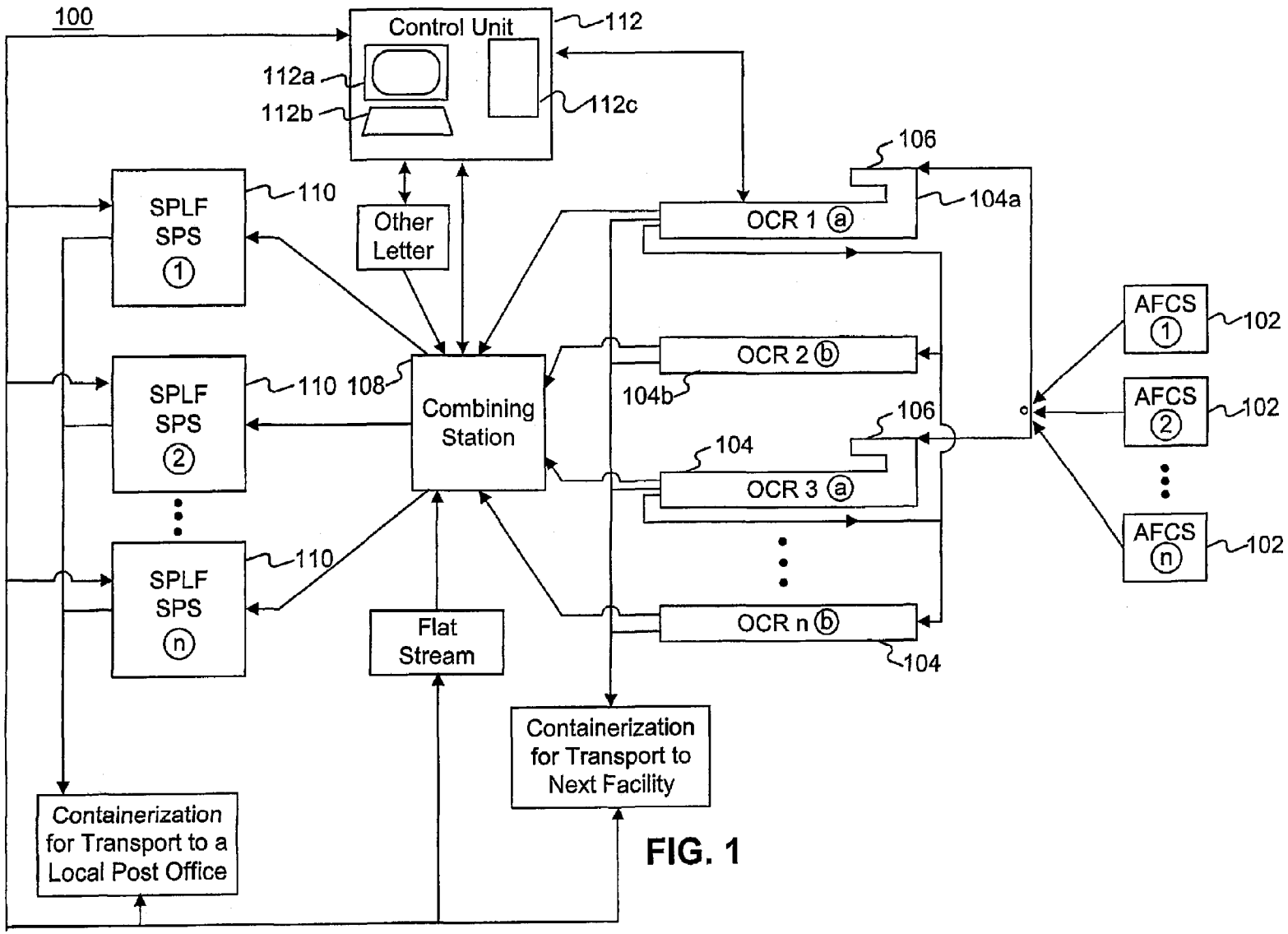
FIG. 1 illustrates a system for sorting and packaging mail for delivery, consistent with the present invention.

FIG. 1 illustrates a system for sorting and packaging mail 100, consistent with the invention. System 100 includes one or more facing components, such as Automatic Facers and Canceller Systems (AFCSs) 102. AFCSs 102 are connected to one or more scanning and sorting components, such as Optical Character Readers ("OCRs") 104, some of which are equipped with a reader 106. One or more combining stations 108 are connected to OCRs 104 or other scanning devices, and to one or more Single Pass Letter and Flat Sorter Sorting and Packaging Systems ("SPLF SPS") 110. A control unit 112 is connected to and in communication with OCRs 104, combining stations 108, and SPFL SPSs 110. Control unit 112 includes a monitor or display 112*a*, a keyboard or other data input device 112*b*, and a processor 112*c*.

Combining stations 108 combine mail from various sources, as shown in FIG. 1, and direct the combined mail to one of SPLF SPSs 100. Combining station 108 is comprised of gates or diverters. Although multiple SPLF SPSs 110 may be served by a single combining station 108, it is more efficient to have multiple combining stations 108, particularly if multiple SPLF SPSs 110 are used.

In the context of mail sorting processes, OCR 104 typically refers not only to the actual optical character reader component of OCRs and DBCSs, which is the component that reads mail addresses and bar codes, but refers to the entire sorting machine OCR 104 that contains OCR readers 106 as well as printers and other components used in sorting mail. OCR 104 was designated as such because it was the first type of sorting machine to use an optical character reader to assist in its sorting function.

OCRs 104 are the most common scanning devices and serve as an exemplary component, but other, more sophisticated scanning devices are consistent with the present invention, such as wide area bar code readers and wide field of view cameras. The incorporation of additional developing technologies is also contemplated, such as name recognition components for scanning systems. Name recognition components are part of an OCR or other scanning system, and are used in conjunction with databases containing information from change of address forms to identify mailpieces requiring change of addresses and to apply new addresses. Such technologies can be incorporated into scanning mechanisms used in the sorting and packaging system 100, without departing from the principles of the present invention.

In FIG. 1, OCR 104*b* is simply an extension of OCR 104*a*. OCR 104*a* has a number of bins assigned to various destinations, and OCR 104*b* similarly has a number of bins assigned to additional locations, where each bin collects mail destined for a particular area or region. By connecting OCRs 104*a* and 104*b*, OCR 104*b* simply becomes an extension of OCR 104*a*, and thus there are more available bins for OCR 104 (OCR 104*a* plus OCR 104*b*).

The number of bins that OCRs 104*a* and 104*b* can sort to in a single pass when OCR 104*a* is connected to OCR 104*b* is greater than the number of bins each OCR 104*a* and 104*b* can sort to in a two passes when unconnected. For example, using known systems, bins must be set aside during the first pass on a single, unconnected OCR to receive mail to be sorted on the second pass, rejected unresolved mail, and mail destined for other processing facilities. If the same OCR is used after reprogramming sort logic on the second pass, similar bins are again required. In contrast, consistent with the present invention, when OCRs are linked, and OCR 104*a* is a continuation of OCR 104*b*, more bins are available to receive mail. In this configuration, mail is directed to bins by areas or regions not serviced by the processing facility, as well as zip codes or groups of zip codes for addresses and post office(s) serviced by the processing facility. Notably, the address or bar code information is read at 104*a*, and the mailpiece never requires scanning or reading again in the same processing facility. Based on a single read or scan, the letter is sent to collection for transport to the next processing facility or sent to combining station 108 before being processed within the same processing facility by the SPLF SPS.

The following example illustrates how connected OCRs 104*a* and 104*b* use fewer bins. If a bin for Los Angeles is located at the output of OCR 104*a*, a letter destined for Los Angeles will be sent by OCR 104*a* to the Los Angeles bin; if the bin for Los Angeles is located at the output of OCR 104*b*, the letter will be sent from OCR 104*a* to OCR 104*b* and then to the Los Angeles bin. If OCR 104*a* and OCR 104*b* were not connected, a Los Angeles (and a San Francisco, a Northeast, a Midwest, etc.) bin or bins would be needed for each of the two OCRs, rather than a shared Los Angeles bin or bins for both OCRs.

Figure 2:
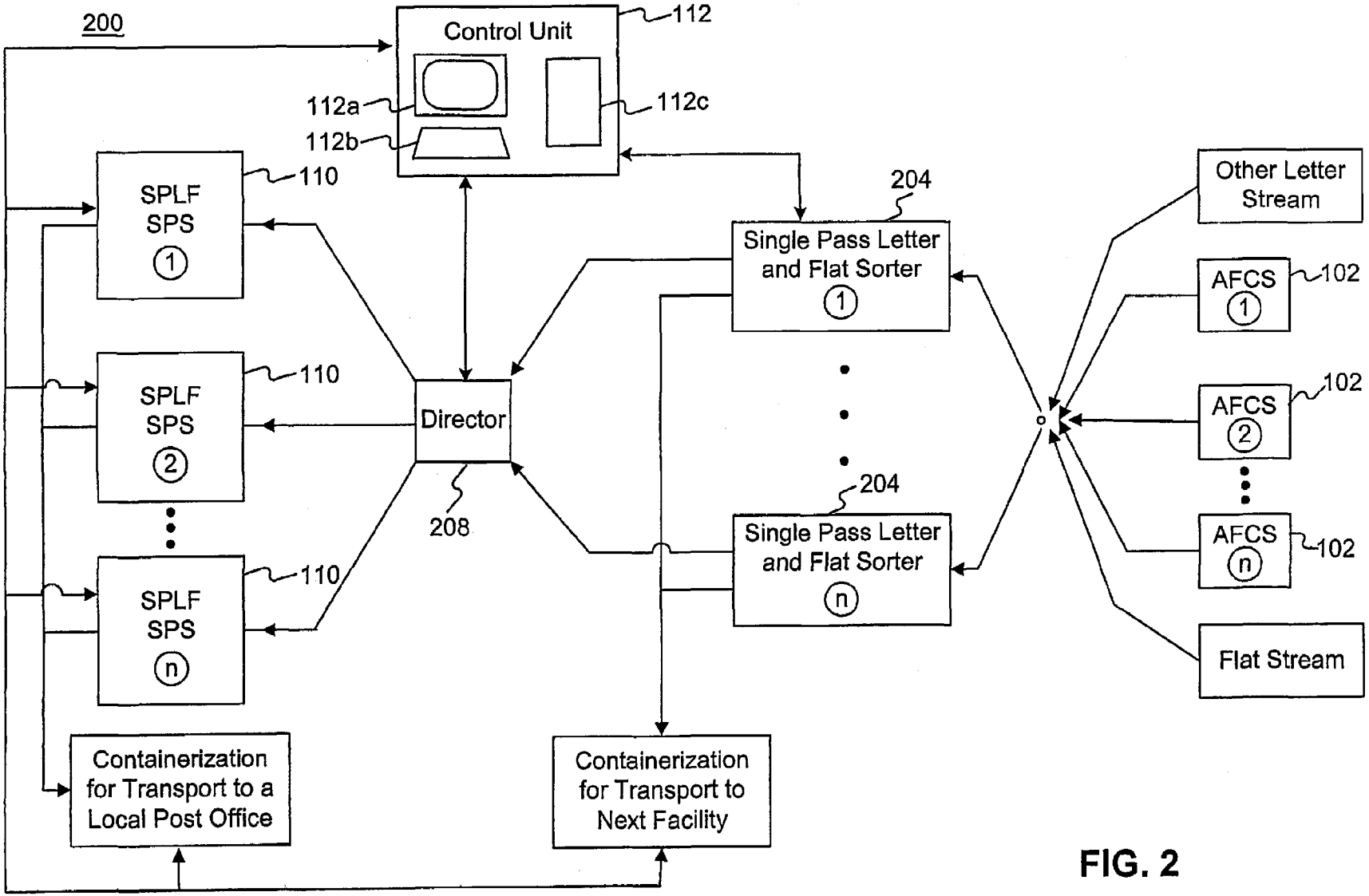
FIG. 2 illustrates another system for sorting and packaging mail for delivery, consistent with the present invention.

FIG. 2 illustrates a system 200 for sorting and packaging mail for delivery, consistent with the invention. System 200 includes one or more facing components, such as Automatic Facers and Canceller Systems (AFCSs) 102. AFCSs 102 are connected to one or more scanning and sorting components, such as such as Single Pass Letter and Flat Sorters ("SPLFS") 204, which are connected to one or more Single Pass Letter and Flat Sorter Sorting and Packaging Systems ("SPLF SPS") 110. If multiple SPLF SPSs 110 are used in sorting and packaging system 200, a director 208 is needed between SPLFS 204 and SPLF SPS 110 in order to direct mail to a particular SPLF SPS 110 based on the address or bar code. A director is comprised of gates or diverters. If only one SPLFS SPS 110 is used, no director 208 is needed as mail is transported directly from SPLFSs 204 to SPLF SPS 110. SPLFSs 204 include scanning, reading, and printing components, like OCRs 104, but a single SPLFS can be used on all types of mail. Control unit 112 is connected to and in communication with SPLFSs 204 and SPFL SPSs 110, and if applicable, director 208. Control unit 112 includes monitor or display 112*a*, keyboard or other data input device 112*b*, and processor 112*c*.

Unlike system 100 described with respect to FIG. 1, system 200 described with respect to FIG. 2 handles regular letter and bulk mail and flat mail simultaneously on the same pieces of equipment. As a result, parallel but separate initial scanning and sorting processes are not required for the letter mail and the flats, and no combining station 108 is needed. FIGS. 12*a*, 12*b*, 13*a*, 13*b* and the accompanying descriptions further describe the methods associated with systems 100 and 200 illustrated in FIGS. 1 and 2.

Figure 3:
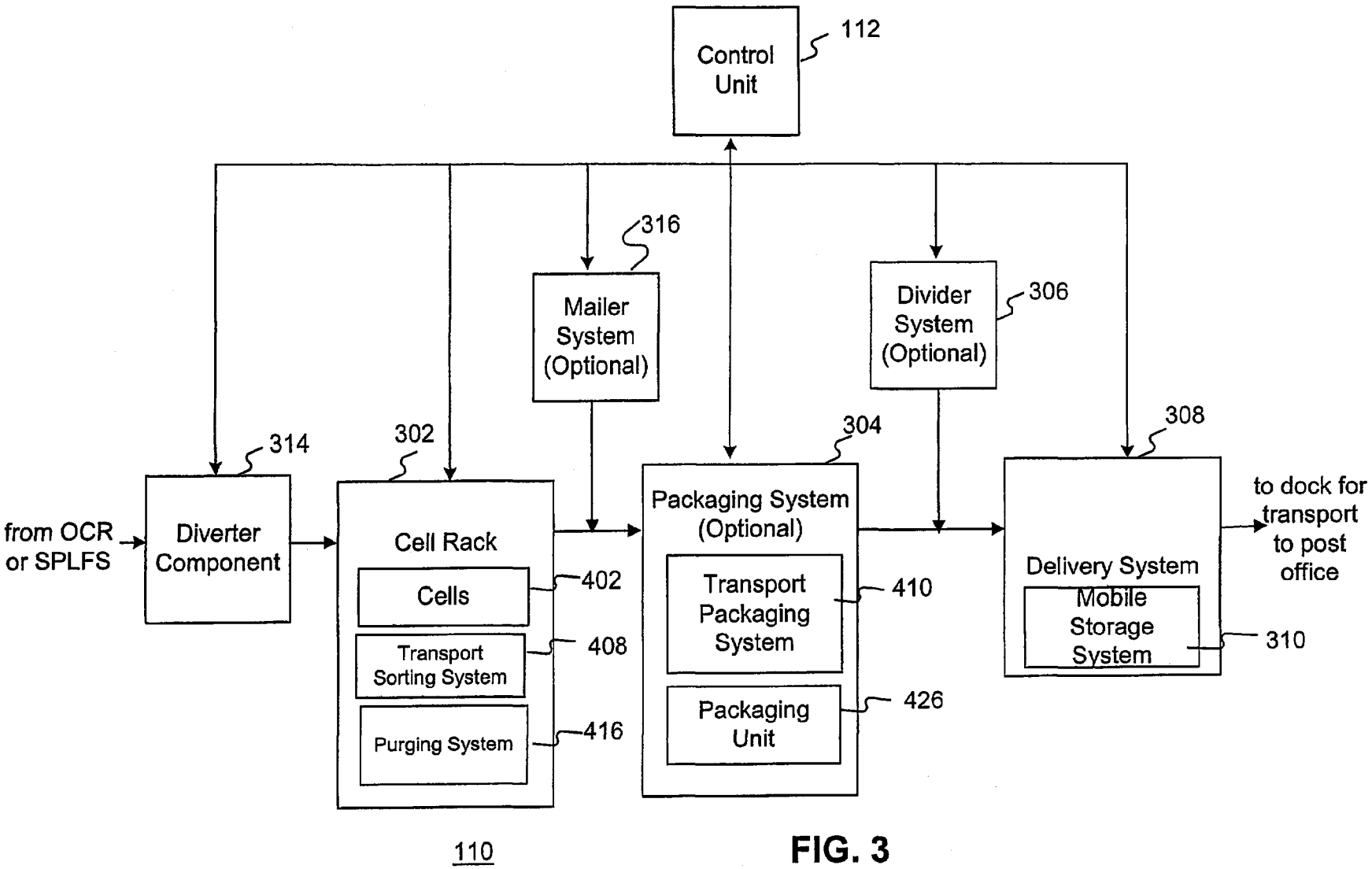
FIG. 3 illustrates a single pass letter and flat sorting and packaging system ("SPLF SPS"), illustrated in FIGS. 1 and 2, consistent with the present invention.

FIG. 3 illustrates single pass letter and flat sorting and packaging system ("SPLF SPS") 110 consistent with the present invention and illustrated in FIGS. 1 and 2. Components of SPLF SPS 110 may include a diverter component 314, a cell rack 302, a circular system 316, a packaging system 304, a divider system 306, a delivery system 308, and a control unit 112. Diverter component 314 is connected to cell rack 302. Cell rack 302 is connected to packaging system 304, which is connected to delivery system 308. Optionally, diverter component 314 is located before cell rack 302, circular system 316 is located between cell rack 302 and packaging system 304, and divider system 306 is located between packaging system 304 and delivery system 308. Control unit 112 works in conjunction with all the components, as previously described. SPLF SPS 110 receives mail from OCRs 104 and SPLFSs 204, and then with the guidance of control unit 112, sorts, sequences, packages, and delivers mailpieces to bins or trays according to their destinations for delivery to local post offices and ultimately residences and businesses.

Control Unit

Control unit 112 is in communication with all of the components of sorting and packaging system 100, 200. It has diagnostic and backup capabilities and directs integrated system components for sorting and packaging system 100, 200, including SPLFS SPS 110. Moreover, control unit processor 112*c* (FIGS. 1 and 2) contains hardware and software for directing, storing, and packaging the mailpieces throughout the sorting and packaging process, and for detecting, resolving, and reporting any malfunctions that occur during the process.

The hardware and software for control unit processor 112*c* performs many functions. It retains bar code and/or address information for each mailpiece and directs each mailpiece to the appropriate container for transport to another processing facility, or cell rack level and cell for further sorting in the present processing facility. It controls the purging and circular processes prior to packaging the mail for delivery to each address. It also controls what mail is packaged together and what trays of mail are stored together prior to delivery to local post offices. Control unit processor 112*c* hardware and software also communicates with all the components of sorting and packaging systems 100 and 200 to troubleshoot. It detects instances when a mailpiece did not arrive at an appropriate cell 402, reroutes mailpieces when appropriate cell 402 is malfunctioning, and detects when and where sorting, packaging, or delivery systems malfunction so that the problem and location can be displayed to an operator on monitor 112*a*.

Cell Rack

Figure 4:
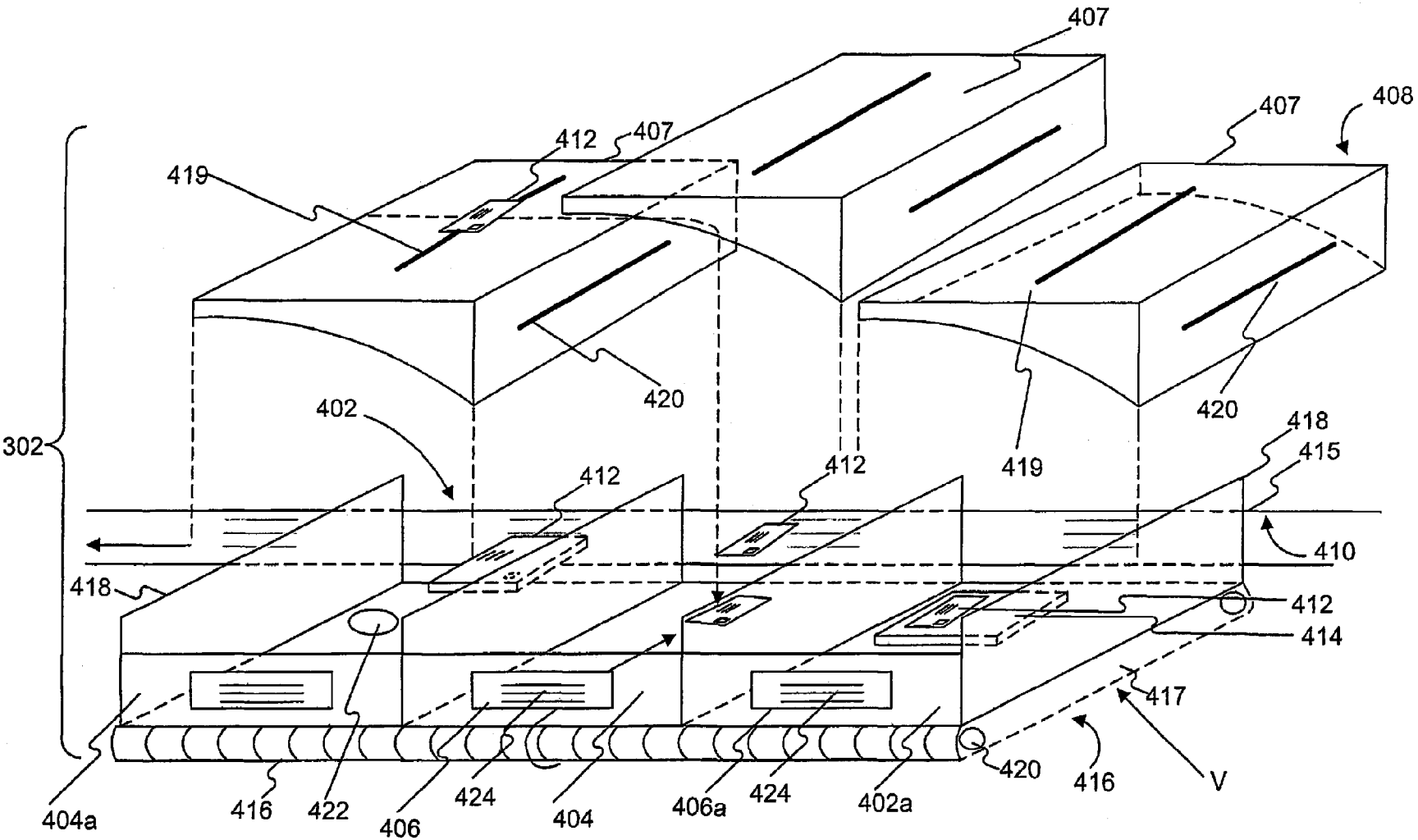
FIG. 4 illustrates a perspective view of a cell rack, consistent with the present invention.
Figure 5:
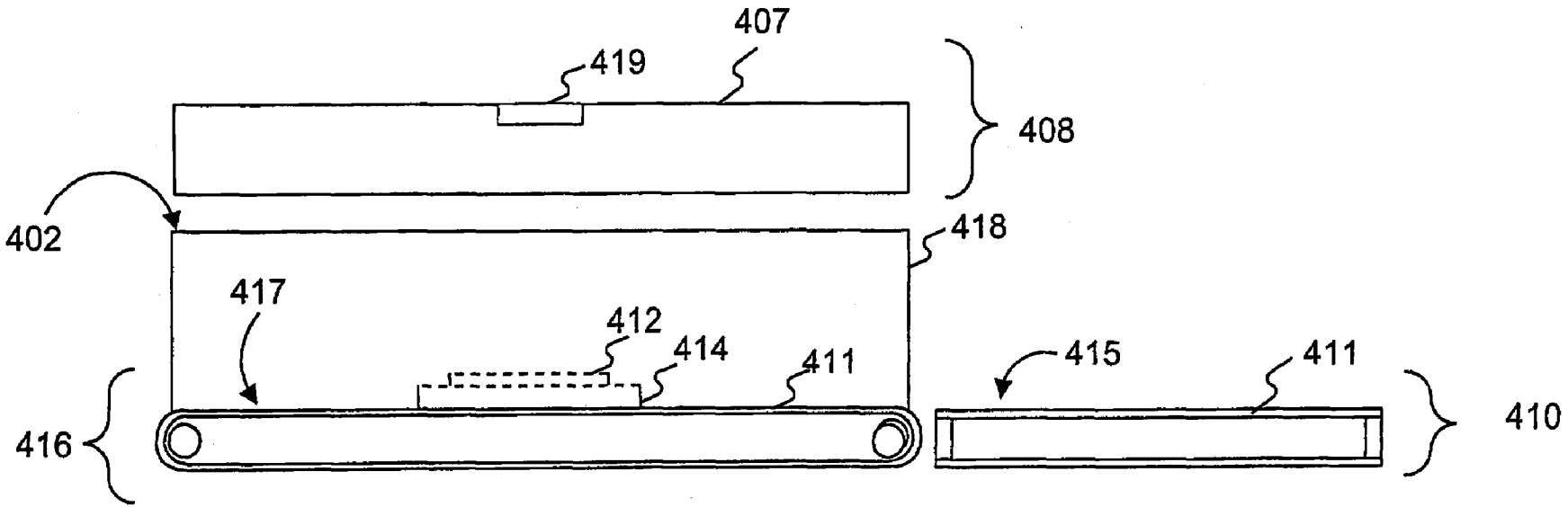
FIG. 5 illustrates a side view of the cell rack illustrated in FIG. 4, consistent with the present invention.

A perspective view of cell rack 302 used in SPLF SPS 110 consistent with the invention is illustrated in FIG. 4. Each cell rack 302 is comprised of a series of individual cells 402, a transport sorting system 408, and a purging system 416. Also depicted in FIG. 4 is a transport packaging system 410, which works in conjunction with cell rack 302 and packaging system 304. FIG. 5 is a side view of cell rack 302, including cells 402, transport sorting system 408, purging system 416, and transport packaging system 410.

An individual cell 402 may correspond to a particular address, (e.g., 102 King Street, Alexandria, Va.) on a particular route number (e.g., 112) serviced by a particular post office (e.g., Alexandria, Va., Old Town branch post office) that is serviced by the mail processing facility in which the cell racks are located (e.g., Merrifield, Va. mail processing facility). Alternatively, an individual cell 402 may correspond to accountable mail (e.g., certified mail requiring a signature for delivery) for a particular route number. If a particular address receives a high volume of mail, it may be assigned more than one cell 402, or may be assigned to a deeper cell.

Generally, the length and width of each cell 402 is large enough to encompass letters 412 and flats 414, where the back side of the mailpiece lies against the bottom of the cell (i.e., the mail lays horizontally, or "flat," in the cell, as opposed to vertically, or "upright"). Such a system avoids potential jamming problems encountered with a vertical cell arrangement, in which letters 412 may get jammed when dropping into cells 402 with different sized flats 414. The depth of each cell 402 can vary, depending on the typical volume of mail expected for the particular address assigned to that cell 402. Each cell 402 also is equipped with a sensor 422 (FIG. 4), which is illustrated on the bottom of cell 402, but may be located anywhere, provided that it informs control unit 112 when a particular cell 402*a* is full, i.e., cell overflow.

Figure 6:
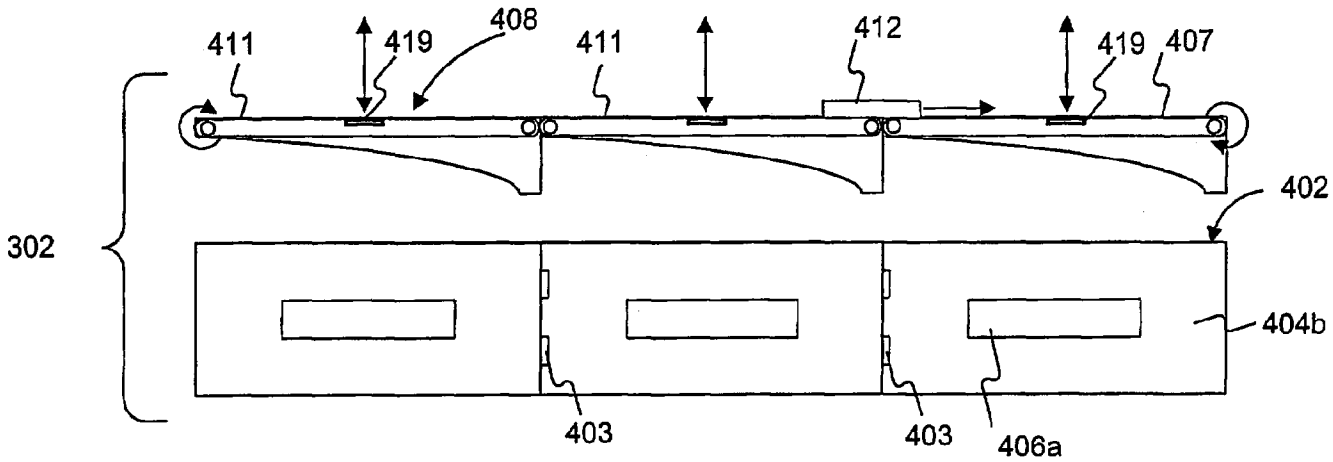
FIG. 6 illustrates a front view of a portion of a cell rack, consistent with the present invention.

As shown in FIGS. 4 and 5, each cell 402 has a pair of side walls 418, one on each side, which may be shared with an adjacent cell 402. Additionally, a front face 404 of each cell 402 may be partially enclosed, as shown by a partial front face 404*a* in FIG. 4. Alternatively, front face 404 may be completely enclosed by a complete front face 404*b* on hinges 403 or another mechanism that allows front face 404*b* to be opened, as shown in FIG. 6. Front face 404 also may be completely open, as shown by an open front face 404*c* in FIG. 7. Regardless of which embodiment of front face 404 is utilized, including but not limited to those described above, front face 404 generally should allow postal personnel to access cell 402. Access might be required to place manually sorted mail, such as mail that was not resolved by the scanning system, inside cell 402, or to address maintenance needs, such as jammed mail in cells 402.

Figure 7:
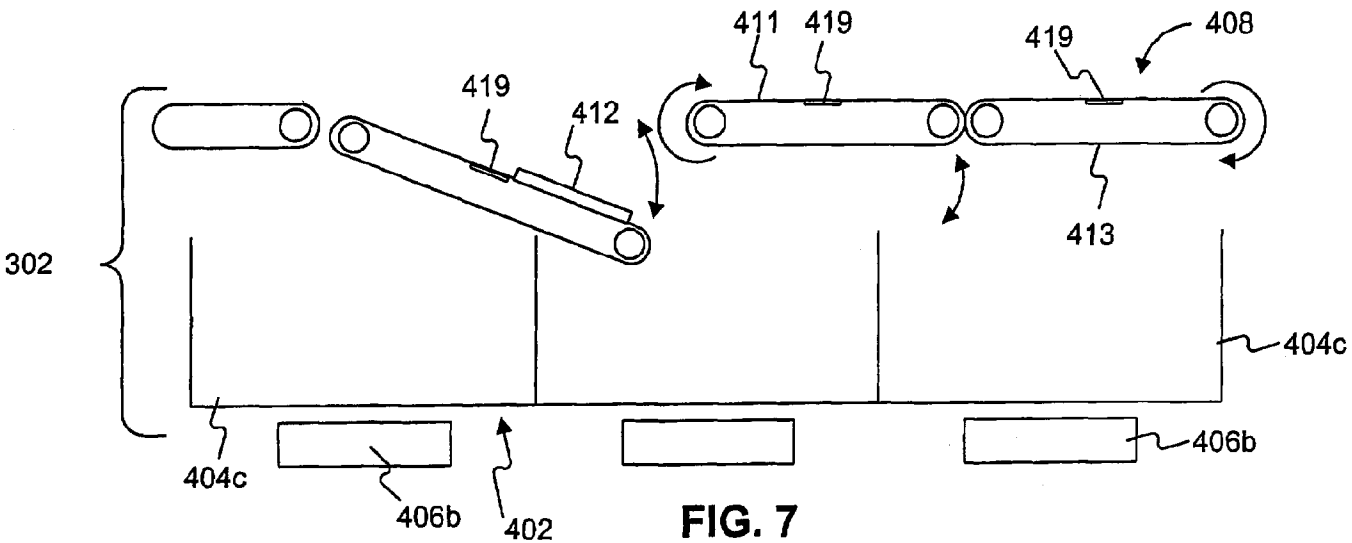
FIG. 7 illustrates a front view of a portion of another cell rack, consistent with the present invention.

Each cell 402 also has a label 406 identifying its particular corresponding address. Label 406 could be a light emitting diode ("LED") or liquid crystal display ("LCD"), in addition to other display means. Each label 406 is identified with a row number and column number along cell rack 302 that is human readable but also is known by control unit 112. Control unit 112 uses this information to direct mail to cells 402 and to purge mail from cells 402 based on algorithms contained in processor 112*c*. Control unit 112 does not use label information to direct mail to cells 402, but control unit 112 itself directs mail to cell 402 and provides label information to labels 406 so that they identify the address, route, information, contents, and other information concerning cell 402. In FIG. 4, label 406*a* appears on partial front face 404*a*. In FIG. 6, label 406*a* appears on complete front face 404*b*. In FIG. 7, label 406*b* appears below open front face 404*c*.

When sensor 422 on cell 402 (FIG. 4) senses cell 402 is approaching a predetermined level, for example 80% full, control unit 112 (FIGS. 1–3) can divert the mail to an overflow cell 402*a* that it is linked to primary cell 402 assigned to that particular address. Control unit 112 can assign overflow cells 402*a* to full, primary cells 402 in a random or a logical order, similar to the way control unit 112 assigns a particular address to a cell 402, discussed further with respect to FIG. 8. All cells 402 have the same label 406 method and format, and label 406 for overflow cell 402*a* would include the same information as other cells 402.

Cells 402 may also be equipped with an indicator 424, such as a light emitting diode ("LED") or liquid crystal display ("LCD"), that not only provides label 406 information, but also identifies and links overflow cell(s) 402*a* to primary cell 402 assigned to the address so that personnel can identify, locate, and cross-reference cell addresses. If an address received more mail than one cell could hold, cell label 406 and/or indicator 424 (such as an LED readout) might read: "20005: carrier route 10, stop 38, cell 1 of 2, 4/5" for primary cell 402, and "20005: carrier route 10, stop 38, cell 2 of 2, 5/5" for overflow cell 402*a*, where "4/5" is the appropriate column and row location for overflow cell 402*a* indicated on indicator 424 of primary cell 402 and "5/5" is the appropriate column and row location for primary cell 402 indicated on indicator 424 of overflow cell 402*a* (and where 20005 is the zip code). All cells in a particular sorting and packaging system 100, 200 have the same label type or system, such as an LED. Cell label 406 also may be operable to identify the contents (i.e., kind of mail) of any cell 402, such as "accountable" or "regular."

Label 406 enables an operator to identify a particular address at a particular cell 402. This allows an operator to place any manually sorted mail in cell 402 and remove mail manually from a cell for delivery to a local post office should transport sorting system 408 or purging system 416 for a particular cell 402 malfunction.

Transport sorting system 408 consists of a transport mechanism 407, for example conveyer belts 411 as in FIGS. 6 and 7. In FIG. 4, transport system 408 is a series of wedge-shaped conveyers 407 having a multitude of conveyer belts 411 (also shown in FIG. 6) along the surface that convey mail, where the wedge-shaped conveyers 407 are triggered to rise up and down and deflect letters 412 and flats 414 into cells 402 by control unit 112. Such a system is shown, from a front view, transporting letter 412 in FIG. 6. However, other forms of transport system 408 may be used, such as a series of planks 413, each plank 413 having a conveyer belt 411, where planks 413 are hinged so as to drop letter 412 down into cell 402 when triggered by control unit 112, as shown in FIG. 7. A solenoid or other electromechanical, hydraulic, or pneumatic device controlled by control unit 112 may be used to raise wedges 407 or lower planks 413. Although wedge-shaped conveyers 407 and planks 413 having conveyer belts 411 that rise and/or fall are described in detail and are consistent with the present invention, any other transport sorting system 408 for transporting items such as mail is adequate. For example, an alternative transport mechanism component comprises arms that sweep or push mailpiece 412 from a continuous conveyer belt located adjacent to cells 402 into cell 402 having the appropriate address.

As shown in FIG. 4, transport sorting system 408 also has detectors 419 and 420 on each wedge 407 or plank 413 in communication with control unit 112. Detectors 419 may be located on the top of wedge 407 or plank 413, and monitor transport of mailpiece 412, 414 from each wedge 407 or plank 413 to the next one to verify mailpiece 412, 414 is moving as it should and to ensure delivery to correct cell 402. Detectors 420 may be located between the sides of adjacent wedges 407 or planks 413 and monitor the position of wedges 407 or planks 413 to confirm that the appropriate wedge 407 or plank 413 was activated to drop mailpiece 412, 414 into cell 402. For example, detectors 419 might be photocell detectors operable to detect when a light beam is broken by the passage of mailpiece 412, 414. Similarly, detectors 420 might be photocell detectors operable to detect when a light beam is measurable, such as when wedge 407 or plank 413 rises or drops away from adjacent wedge 407 or plank 413. Photocell detectors serve as an example only, and any detectors 419, 420 capable of sensing when mail 412, 414 has passed or when transport system 308 is activated to insert or discharge mailpiece 412, 414 into cell 402, such as proximity sensors, are adequate.

Control unit 112 communicates with detectors 419, 420 and troubleshoots by alerting an operator watching monitor 112*a* when jams, faults, or other errors in the sorting and packaging system are detected. Control unit 112 sends information about the expected location of a particular mailpiece to, and receives information about the detection of that mailpiece from, detector 419. Control unit 112 also sends information to transport system 308, such as wedge 407 or plank 413, to drop a particular mailpiece into a particular cell, and detector 420 returns information to control unit 112 indicating that that particular wedge 407 rose or plank 413 dropped that mailpiece as expected. If control unit 112 and detectors 419 or 420 detect a problem, the sorting and packaging system will be shut down and the problem located.

Purging system 416, shown in FIGS. 4 and 5, comprises a transport mechanism 417, such as a conveyer belt 411 or any other transport mechanism. Consistent with the invention, transport mechanism 417 of purging system 416 may serve as the bottom of each cell 402, and extend from the front face 406 of cell 402 to the rear of cell 402. Transport mechanism 417 of purging system 416 may be perpendicular to and level with transport packaging system 410 (see FIG. 5), so that when purging system 416 is triggered, letters 412 and flats 414 are conveyed by transport mechanism from cell 402 to transport packaging system 410. When two cells 402*a* and 402 contain mail for the same address due to overflow from primary cell 402, control unit 112 can alert purging system 416 and transport packaging system 410 to empty cells 402 and 402*a* sequentially and merge the mail before packaging unit 426.

The purging system 416 illustrated in FIG. 4 is exemplary, but any purging system 416 for transporting items such as mail is adequate and consistent with the invention. In addition to conveyer belts 411, purging system 416 could be solenoid-activated, hydraulic, electric, or pneumatic, among others. Purging system 416 could be as simple as raising up the edge of the bottom of cell 402 closest to front face 404 to slide or drop mail onto transport system 308, where purging system 416 is adjacent to but higher than transport system 308.

Figure 8:
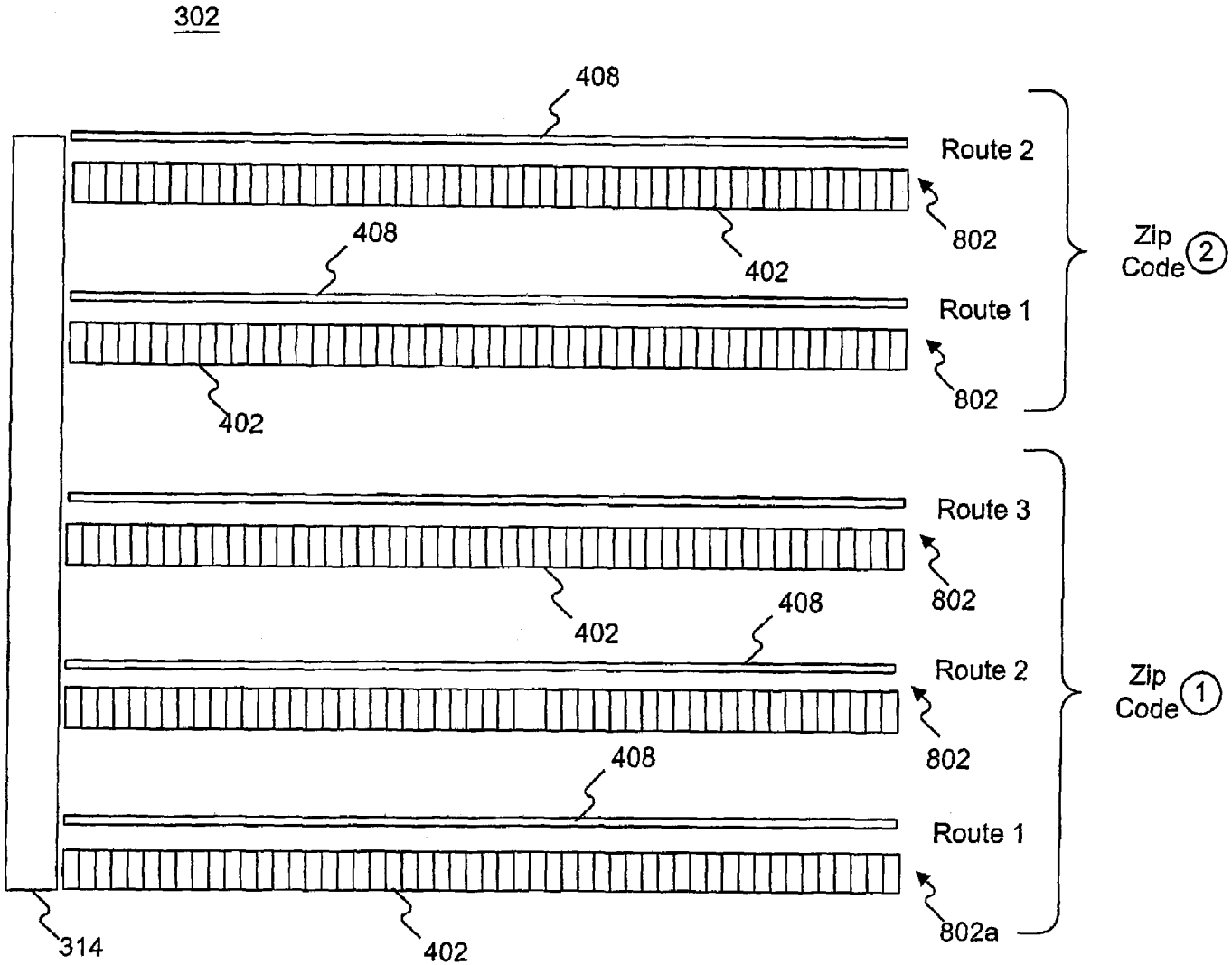
FIG. 8 illustrates a front view of a cell rack, consistent with the present invention.

FIG. 8 illustrates a front view of a multitude of cell racks 302 comprising, by example only, five "shelves" or levels 802 and having a diverter component 314. Each level 802 has transport sorting system 408 above cells 402 and corresponding transport packaging system 410 adjacent to cells 402 (FIG. 4). Transport sorting systems 408 on various levels 802 are fed by a diverter component 314 that communicates with control unit 112 and directs a mailpiece from combining station 108 (FIG. 1), SPLFS 204 (FIG. 2), or director 208 (FIG. 2) to the appropriate level 802 containing cell 402 corresponding to the particular address on the mailpiece. Diverter component 314 may be any assembly of wheels, belts, elevators, or gates capable of dispatching mail to the correct level 802 of cell rack 302. If there is only one level 802, diverter component 314 is not needed.

FIG. 8 illustrates an exemplary configuration of cell rack 302. For example, each section of cell rack 302 may correspond to a particular mail route for a particular zip code, where each cell 402 is a specific address along a particular route. Generally, cells 402 are arranged in delivery sequence order according to the mail route, and mail routes within a particular zip code are proximate to one another.

Each cell 402 is logically arranged by post office, route, and address so that personnel who have to manually insert or remove mail can easily find the location of the cell corresponding to a particular address. Other cell arrangements, however, such as cells 402 randomly arranged along cell rack 302, also may be used. The sorting and packaging system knows which cell or cells 402 are assigned to which address, thus a sequential order embodiment, such as the one depicted in FIG. 8, is not required for the control unit 112 to direct mail to discharge into the correct cell 402 or to be purged from cell 402 for packaging in delivery order. Control unit 112 (FIGS. 1 and 2) can assign addresses to cells 402 in any order or arrangement. Nevertheless, a logical arrangement simply makes it easier to conduct any residual manual sorting or mail removal, and cell arrangement typically is based on operator desires.

Some cells 402 for heavy-volume addresses are deeper than others. Examples of such addresses might include the IRS, City Hall, banks, etc. Optionally, bins or trays for these addresses may serve as cells 402 along the bottom level 802*a* of cell rack 302 (FIG. 8). SPLF SPS 110 (FIG. 3) would sort mail destined for these addresses, the mail would be directed by control unit 112 to level 802*a* along the bottom of cell rack 302, and the mail would be collected in bins that postal carriers could deliver directly to the address without further sorting.

Packaging System

Packaging system 304 (FIG. 3) comprises transport packaging system 410 (FIG. 4) for transporting letters 412 and flats 414 from cells 402 to a packaging unit 426. Transport packaging system 410, shown in FIGS. 4 and 6, also comprises transport mechanism 415, such as conveyer belts 411 similar to that described above for transport sorting system 408 and purging system 416. Transport packaging mechanism 410 also includes additional components known in the art, including gates or diverters, temporary storage buffers, material handling equipment, controls, etc. Transport mechanism 415 of transport packaging system 410 may be perpendicular to and level with transport mechanism 417 of purging system 416 (FIG. 5), so that when purging system 416 is triggered, letters 412 and flats 414 are conveyed from cell 402 to transport packaging system 410. Transport packaging system 410 extends from a first cell 402 in cell rack 302 beyond a last cell 402 in cell rack 302 to packaging unit 426. Packaging unit 426 consists of a system for packaging mail 412, 414 destined for a particular address into a bundle or package 900, such as those illustrated in FIGS. 9 and 10.

Figure 9:
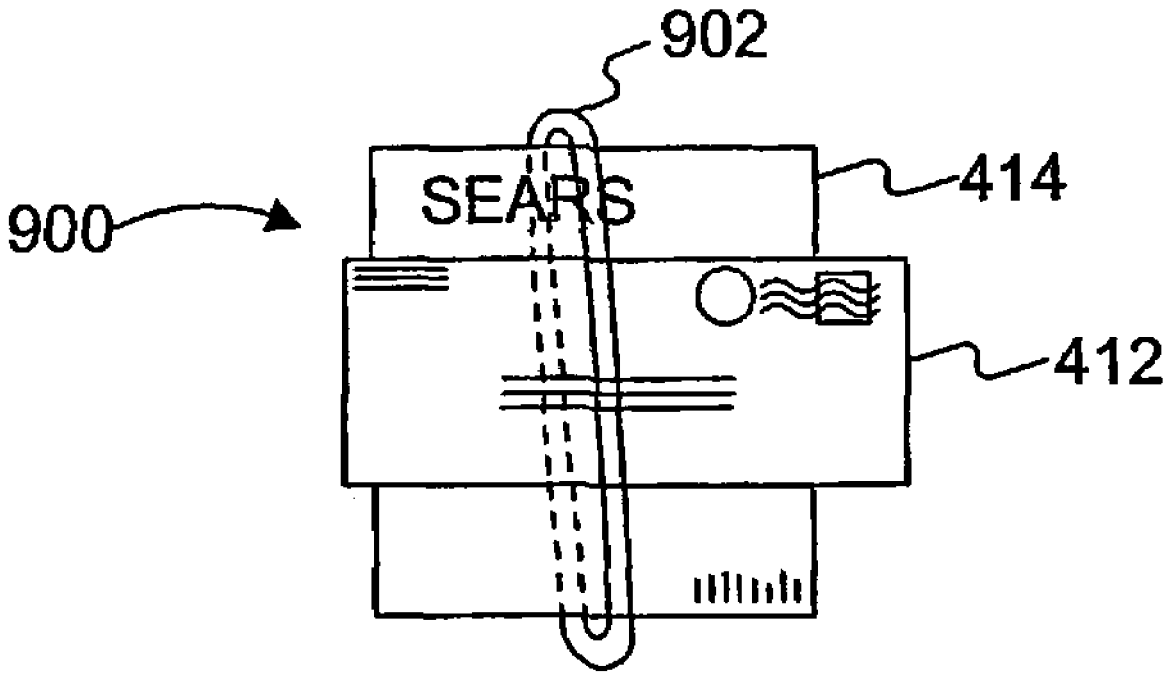
FIG. 9 illustrates a package, consistent with the present invention.

FIG. 9 illustrates an embodiment of package 900 in accordance with the sorting and packaging system and method. A band 902 applied at packaging station 310 surrounds a stack of letters 412 and flats 414 destined for a particular address or route or destination. Band 902 may be elastic, plastic, rubber, string, fabric, wire, shrink wrap, or any other material that can easily be applied by packaging unit 426 around varying thicknesses of stacks of mail and that can also easily be removed from the stack of mail by a postal carrier upon delivery or a postal patron upon receipt, such as by stretching, untying, or separating.

Figure 10A:
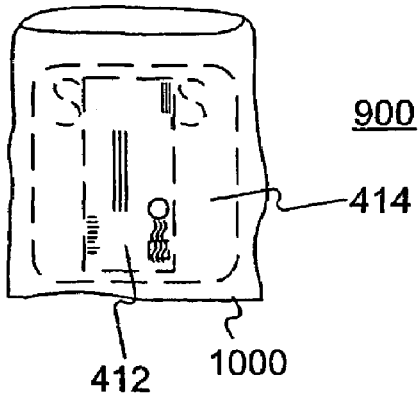
FIGS. 10*a*–10*c* illustrate another package, consistent with the present invention.
Figure 10B:
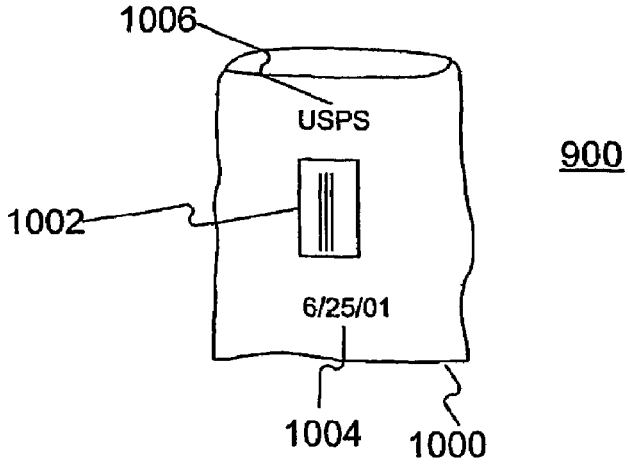
Figure 10C:
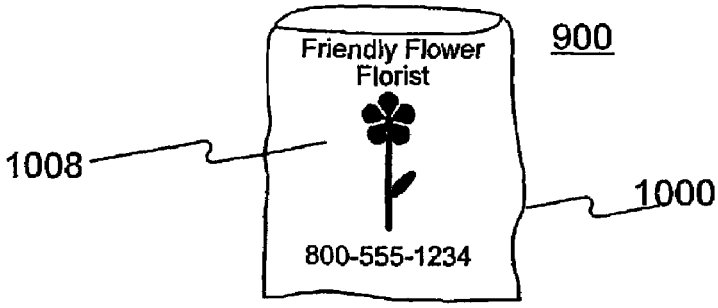

FIGS. 10*a*–10*c* illustrate another embodiment of package 900. A bag 1000 contains a stack of letters 412 and flats 414 destined for a particular address or route or destination. Bag 1000 may be fabric, plastic, paper, shrink wrap, or any other suitable material strong enough to hold a stack of mail. Bag 1000 can be entirely transparent, as shown in FIG. 10*a*, or have a window 1102 in the proximity of the address, as shown in FIG. 10*b*, to enable a postal carrier to see the address on a mailpiece within bag 1000. Bag 1000 may be open, or may have a drawstring or a flap closure to prevent mail from falling out and to protect mail from the elements. Bag 1000 also may include a delivery date stamp 1104 or a logo 1106 on one side, and an advertisement on the other side, as shown in FIGS. 10*b* and 10*c*. Bag 1000 should be of appropriate dimensions to enable packaging unit 426 to package varying thicknesses of stacks of mail. Although FIGS. 9 and 10 illustrate two packaging devices, band 902 and bag 1000, any packaging device that "packages" or separates mail for a particular destination, such as a large envelope, a clip, and any similar devices, may be applied by packaging unit 426.

Circular System

Circular system 316 (FIG. 3) is an optional component of SPLF SPS 110. It may be located between cell rack 302 and packaging unit 426 as shown in FIG. 3. Alternatively, though not illustrated, circular system 316 may be located just before combining station 108 (FIG. 1) or director 208 (FIG. 2), or before diverter component 314 (FIG. 3). Circular system 316 is any material handling system operable to transport, drop, or slide circulars onto transport packaging system 410 prior to the packaging of mail for each address at packaging unit 426. Circulars, such as weekly supermarket flyers, are addressed to generic "residents" and are included in packages 900 sent to each address, but do not need to be read or scanned like regular letters 412 or flat mail 414. Therefore, circular system 316, in conjunction with control unit 112, ensures that circulars are transported onto transport packaging system 310 between mailpieces destined for each address.

Consistent with the present invention, circular system 316 can be a box located over transport packaging system 410 and before packaging unit 426 containing circulars that is triggered by control unit 112 to drop a circular onto transport mechanism 410 before or after all other mail for a particular address has passed by. Control unit 112 triggers circular system 316 again once the next "batch" of mail for the next address on a route has passed by. Based on the bar code read at the beginning of the sorting process and the known timing of the process, control unit 112 knows when to drop the circular and is programmed to do so between addresses. Other types of circular systems 316 can also be used, provided they are operable to insert circulars between mail addressed to two different addresses on transport packaging system 410.

Delivery System

Delivery system 308, shown in FIG. 3, comprises a transport mechanism 417 (not shown), such as conveyer belts 411 or other transport mechanisms 407, 415, 417 similar to those described with respect to FIG. 4 for transport sorting 408, transport packaging 410, and purging 416 systems. Delivery system 308 extends from packaging unit 426 to mobile storage system 310 located near a dock area at the postal processing facility.

Figure 11A:
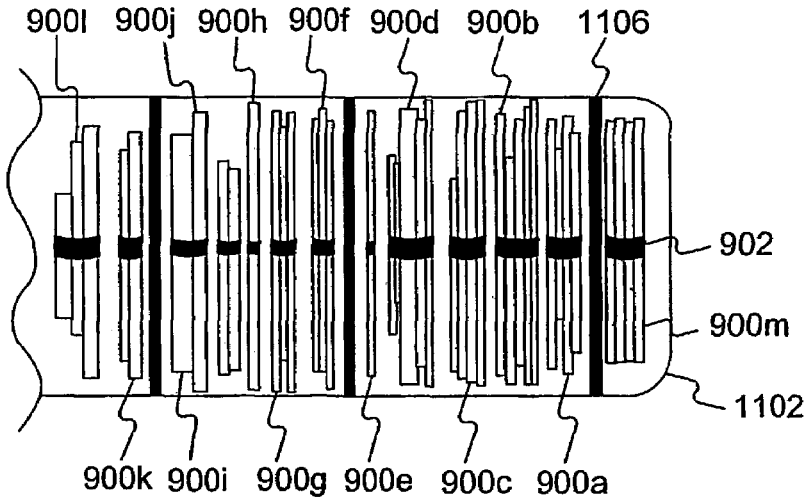
FIG. 11*a* illustrates a mail tray containing sorted, packaged, and divided mail prepared for sequential delivery.

FIG. 11*a* illustrates an embodiment of a mail tray 1102 containing sorted, packaged, and divided mail packages (900*a*–900*m*) prepared for delivery consistent with the sorting and packaging system and method. Tray 1102 may be delivered to a post office or a postal carrier's truck, for example. Trays 1102 may have identification tags or labels 1114 (FIG. 11*b*) for a postal carrier's use in identifying a route number and tray sequence number, e.g., "20005, route 30, tray 3/6."

Each mail package 900 in tray 1102 is encompassed by a packaging device, such as band 902, applied at packaging unit 426. Each package 900 is arranged in sequence according to delivery order for a particular postal route based on its arrival at tray 1102.

One package 900*m* may be a stack of accountable mail for a particular route, which contains all accountable mail for all addresses on that route. Accountable package 900*m* might be placed at the front of tray 1102, the first tray for the route. Also, band 902 or bag 1000 for accountable mail package 900*m* could be an alternative color or be otherwise distinguishable to alert a postal carrier that it contains accountable mail in need of special processing (C.O.D.) or a signature.

A series of dividers 1106 (FIG. 11*a*) can be automatically inserted by divider system 306 (FIG. 3) triggered by control unit 112 between packages 900 during the loading of packages 900 into tray 1102 to separate sets of packages 900. At the command of control unit 112, divider system 306 inserts divider 1106 on transport mechanism 417 for delivery system 308 conveying packages from packaging unit 426 to tray 1102. Divider 1106 is inserted into the delivery process at a particular location dictated by control unit 112, such as between two different blocks or between packages of mail on a postal route. Delivery system 308 treats dividers 1106 as packages 900 and simply places divider 1106 behind the preceding package 900.

Control unit 112 could be programmed so that dividers 1106 are inserted by divider system 306 to separate one block of a route from another block. Similarly, dividers 1106 may be inserted to separate mail destined for mailboxes in neighborhood delivery collection box units ("NDCBUs"). An NDCBU is a fixture or case that contains mailboxes for multiple addresses at one location, such as a small building, condominium complex, apartment complex, or townhouse-type neighborhood.

For explanatory purposes only, assume a postal carrier has a residential route and delivers to two NDCBUs located in an apartment complex, each having five mailboxes, before delivering mail to single family homes on his route. Based on FIG. 11*a*, if mailboxes 1–5 are located in a first NDCBU and mailboxes 6–10 are in a second NDCBU, divider system 306 would insert divider 1106 before package 900*a* destined for mailbox 1, before package 900*f* destined for mailbox 6, and before package 900*k* destined for whatever single family home address follows the second NDCBU on the postal route. The postal carrier then knows that all mail between the first and second dividers is destined for the first NDCBU, all mail between the second and third dividers is destined for the second NDCBU, and all mail after the third divider is destined for the single family homes on the postal route. As previously discussed, package 900*m* before the first divider is all the accountable mail for the route.

Figure 11B:
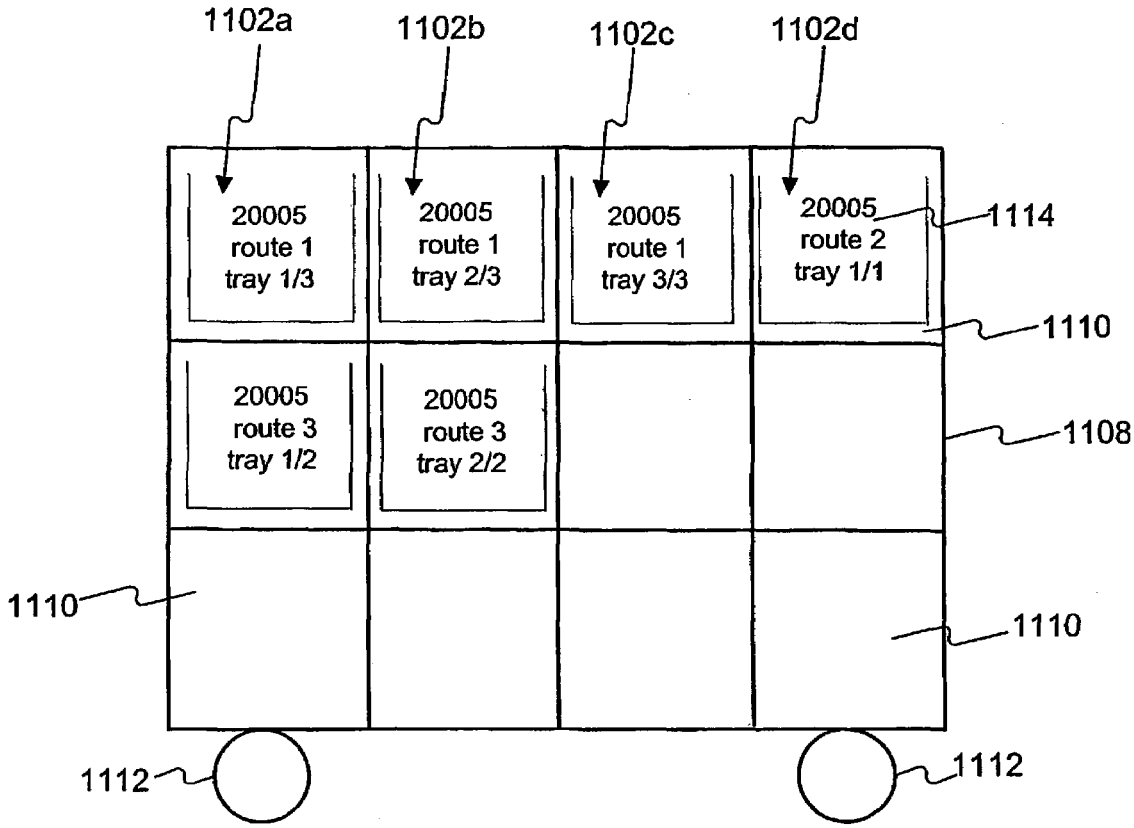
FIG. 11*b* illustrates a mobile storage unit containing mail trays, consistent with the present invention.

FIG. 11*b* illustrates a mobile storage unit 1108 used by mobile storage system 310, a component of delivery system 308. Trays 1102 are filled in delivery sequence by delivery system 308, thus all mail for a particular zip code fills tray 1, tray 2, etc. for a particular route in that zip code. Mobile storage unit 1108 has cells 1100 to store individual trays 1102 in delivery order. Mobile storage unit 1108 also has wheels 1112 or a similar transport mechanism, such as a monorail, for transporting mobile storage unit 1108 from the end of delivery system 308 to a loading dock. At the dock, postal trucks servicing post offices and other postal facilities are loaded.

Mobile storage system 310 is a material handling system that moves trays 1102 into cells 1110 of mobile storage units 1108. Mobile storage system 310 can be an indexed feeder, a robot arm, or any other mechanical mechanism for relocating trays from the end of delivery system 308 to sequential cells 1110 of nearby mobile storage unit 1108. Control unit 112 indicates when the first tray 1102*a* (FIG. 11*b*) for a particular route is full, directs mobile storage system 310 to relocate tray 1102*a* to cell 1110 in mobile storage unit 1108, and directs delivery system 308 to begin to fill the next tray 1102*b* for the route. Control unit 112 also can direct mobile storage system 310 to print and apply a label 1114 to trays 1102 indicating, for example, the zip code, route number, and tray number (as in FIG. 11*b*), before storing trays 1102 in mobile storage unit 1108.

Although sorting and packaging systems 100 and 200 illustrated in FIGS. 1–11 are mainly described using components such as AFCSs 102, OCRs 104, cell racks 302, and transport mechanisms 407, 415, 417, any specific component or components that automatically face mail, scan and resolve addresses, spray bar codes, transport, sort, package, and deliver mail are consistent with the present invention.

Sorting and Packaging Method

Figure 12A:
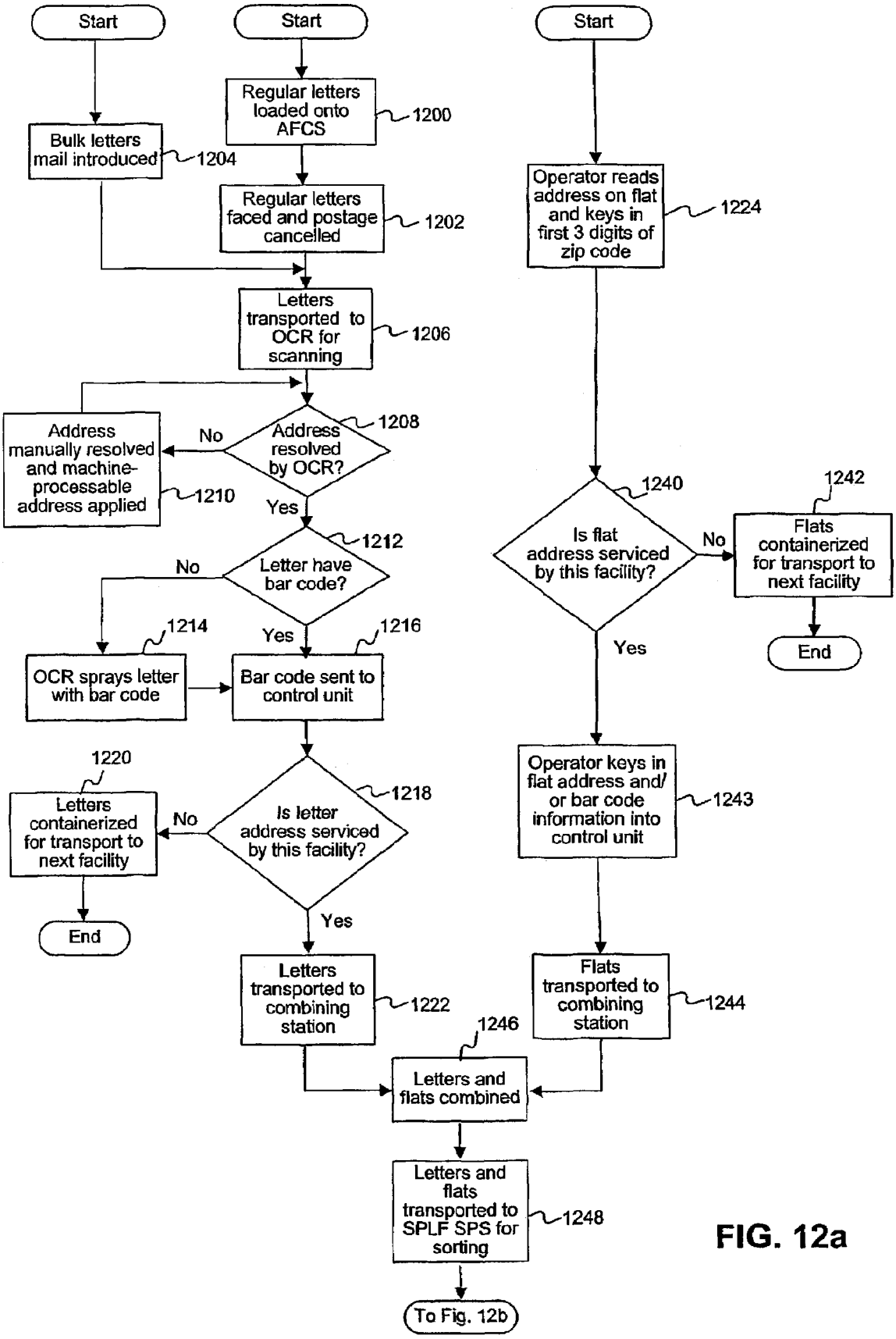
FIGS. 12*a* and 12*b* illustrate an exemplary flowchart of the sorting and packaging method used by the sorting and packaging system illustrated in FIG. 1, consistent with the present invention.
Figure 12B:
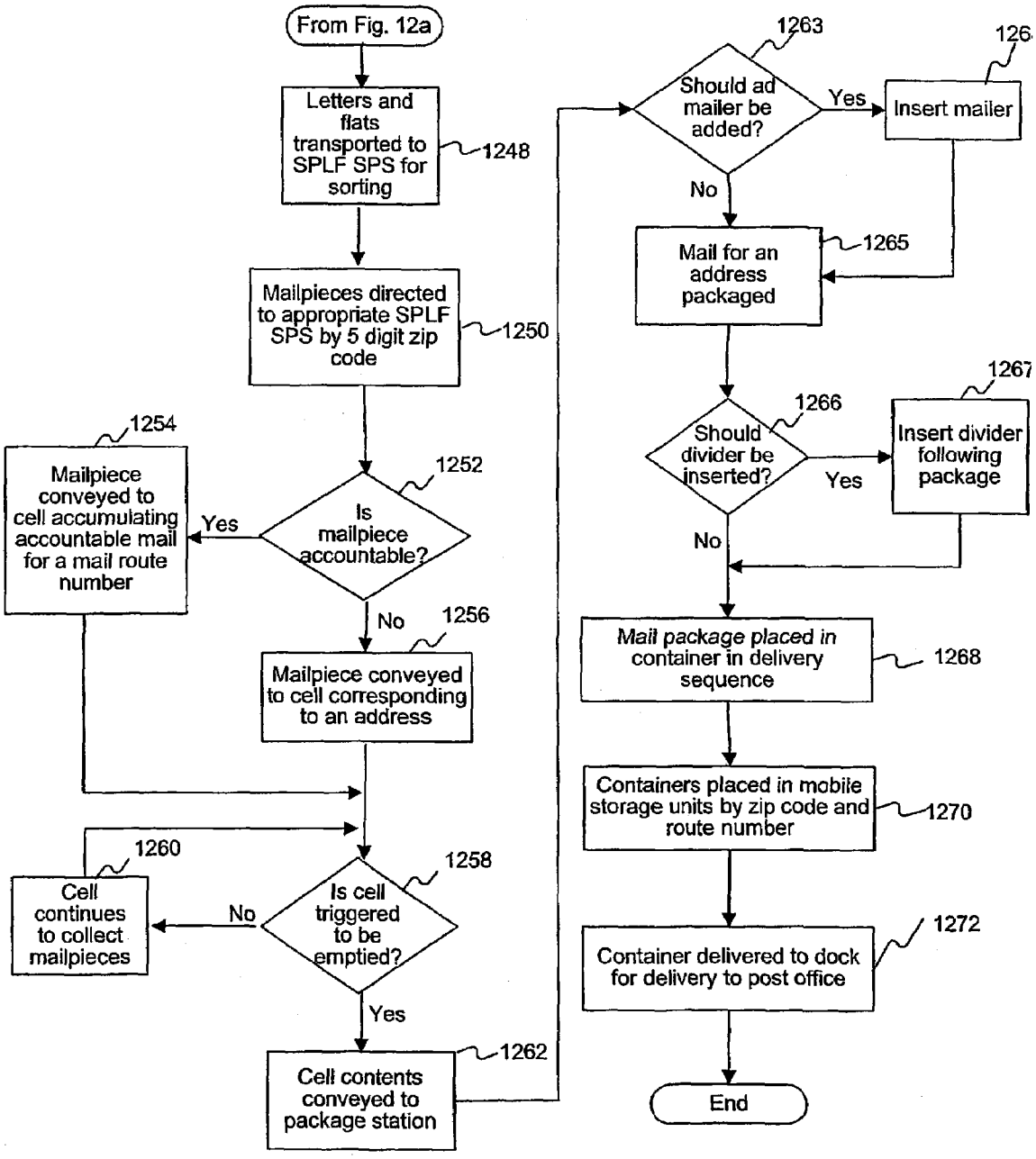

FIGS. 12*a* and 12*b* illustrate an exemplary flowchart describing a sorting and packaging method that may be used by sorting and packaging system 100 illustrated in FIG. 1. In this sorting and packaging method, letters (i.e., commonly-sized envelopes, postcards, etc.) are sorted differently than flats (i.e., flyers, magazines, and similar "flat" mailpieces that are typically larger or thicker than letter mail). In this system 100, letter sorting is automated, while flat mail sorting is partially manual because equipment presently utilized by USPS processing facilities cannot currently accommodate flat mail.

Regular letters are loaded onto AFCSs 102 (FIG. 1) in stage 1200 of FIG. 12*a*. AFCS 102 "faces" the letters, i.e., positions the letters in a particular orientation or direction, so that the address or barcode will be scannable by OCR reader 106 (stage 1202). AFCS 102 also cancels the postage on the letters in stage 1202. Once the letters are faced, bulk letter mail can be introduced (stage 1204) into the mailstream. Bulk letter mail includes items such as mass mailings from utility companies, credit card companies, banks, etc., and is distinguishable from regular letter mail in that bulk letter mail is already faced, does not have a stamp to cancel, and may already have a preprinted barcode.

In stage 1206, mail (including combined regular letter and bulk mail) is transported using known transport mechanisms, such as conveyer belts 411, to OCR 104 for scanning. OCR 104 (FIG. 1) scans the mailing address with a reader 106 (stage 1206). The address may be in machine-printed or handwritten form, such as for a birthday card envelope, or may be in bar code form, such as for a utility bill.

If the address is not resolved by OCR 104 (FIG. 1) because OCR 104 is unable to scan and interpret the address (stage 1208) due to the color of the ink, the font, the handwriting, etc., the mailpiece is sent to a reject bin, the address is manually resolved, and a machine-processable address is applied (stage 1210). If OCR 104 is able to read or resolve the address, OCR 104 then checks whether the letter has a bar code (stage 1212). If the letter does not have a barcode, OCR 104 "sprays," or prints, a barcode corresponding to the written address on the front of the mailpiece (stage 1214). OCR 104 then sends the recently sprayed or pre-existing bar code (stage 1216) to the control unit 112, which stores the information in processor 112*c* (FIG. 1). Notably, OCR 104 never has to read the address or barcode again if the mail is processed for delivery in the same plant. If the mail is sent to another processing facility for further sorting, such as a different city, the bar code will be read again, but the address will not have to be resolved again on expensive equipment.

Based on the bar code, which represents the destination of the letter, OCR 104, in conjunction with control unit processor 112*c*, determines whether the address on the letter is "serviced" by the postal facility currently sorting the letter (stage 1218). For example, a letter sent from Merrifield, Va. to the adjacent town of Arlington, Va. would be serviced by the postal processing plant initially sorting the letter in Merrifield, while a letter sent from Merrifield, Va. to Los Angeles, Calif. would not be serviced by the postal processing plant initially sorting the letter in Merrifield, Va. Rather, a rough sort would be conducted at Merrifield in order to get the letter to Los Angeles, and further sorting to the destination address would be conducted by the postal processing facility in Los Angeles.

If the letter is not serviced by the processing facility presently sorting the letter, the letter is sent to a container for transport to another postal facility (stage 1220). For example, as discussed with respect to FIG. 1, if the Los Angeles bin corresponds to OCR 104*b*, the letter destined for Los Angeles is sent from OCR 104*a* to OCR 104*b* to the Los Angeles bin. All the letters destined for Los Angeles are collected in the bin, the contents of the bin are transported to the dock, and the bin is containerized for transport to the postal processing plant servicing the Los Angeles area, where the mail will be further sorted (based on the bar code). If the letter is serviced by the facility presently sorting the letter, the letter is transported to the combining station 108 (stage 1222), where it is combined with the flat mail stream for further sorting to its ultimate destination by SPLF SPS 110, based on the information retained by control unit 112 (FIG. 1).

While the regular letter and bulk mail undergoes the initial sorting process (stages 1200 to 1222) under the sorting and packaging method that may be used by sorting and packaging system 100 illustrated in FIG. 1, flat mail is semi-manually sorted (step 1224). Operators read and enter the first three digits of the zip code, and control unit 112 determines if the flat mailpiece is serviced by the processing facility sorting the flat (step 1240). If the flat is not serviced by the processing facility, the flat is sent to a container for transport to another postal facility (stage 1242). If the flat is serviced by the processing facility, the operator must enter additional zip code or bar code information for each flat mailpiece before it can be directed to combining station 108. A scanner or keypad entry connected to control unit 112 serves this data entry purpose until fully automated methods are available.

Again, similar to stage 1222 for the letter, flats are also transported to combining station 108 in stage 1244, where they are combined with regular letter and bulk mail (stage 1246) before being transported to the Single Pass Letter and Flat Sorting and Packaging System ("SPLF SPS") 110 by transport sorting system 408 for additional sorting and packaging for a specific post office, route, and address, based on the information retained by control unit 112 (FIG. 1) and sorting computer programs stored in processor 112*c*.

A method associated with SPLF SPS 110 of sorting and packaging system 100 (FIG. 1) consistent with the present invention is depicted in FIG. 12*b*, which is a continuation of the flow from FIG. 12*a*. Based on the bar code information retained by control unit 112, representing, at minimum, a five digit zip code, the (now combined) letters and flats are sent to an appropriate SPLF SPS 110 (stage 1250). SPLF SPS 110, in conjunction with control unit 112, determines if the mailpiece is accountable or regular mail (stage 1252).

An accountable mailpiece is identified by control unit 112 when the mailpiece is initially scanned. In addition to the address, the scanner, such as OCR 104, reads the accountable bar code identifier. This identification on the face of the mailpiece defines the type of accountable service requested, such as certified, return receipt, insured, etc. The accountable information is sent to control unit 112, which directs the accountable mail to a cell containing accountable mail for the particular carrier route, and creates an accountable mail manifest for each carrier route.

If the mailpiece is accountable, it is conveyed by sorting transport system 408 (FIG. 4) to cell 402 collecting accountable mail for a particular mail route number (stage 1254). If the mailpiece is not accountable, the mailpiece is conveyed by transport sorting system 408 to cell 402 corresponding to the particular address represented by the barcode on the mailpiece (stage 1256). Control unit 112, and specifically processor 112*c* (FIG. 1) with sorting programs, directs the flow of mail and triggers mail to drop into a cell or be purged from a cell and packaged. If sensor 422 senses that cell 402 is becoming full, it sends a signal to control unit 112, which assigns the address to a new overflow cell 402*a* and directs transport sorting system 408 to sort mail to the overflow cell 402*a*.

Control unit 112 (FIG. 1) triggers purging system 416 (FIG. 4) to empty cells 402 at predetermined intervals. Cell 402 corresponding to a particular address, route, and post office is emptied when the mail destined for that post office needs to be packaged and delivered to the post office. Cells 402 are triggered to be emptied so that mail is packaged and transported to trays 1102 in delivery order (FIG. 11). Cells are emptied by purging system 416, which conveys mail from cell 402 to transport packaging system 410.

If cell 402 for a particular address is triggered to be emptied by purging system 416 (stage 1258), the contents of cell 402 are conveyed to packaging system 304 by transport packaging system 410 described with respect to FIG. 4 (stage 1262). If cell 402 for a particular address is not triggered to be emptied, cell 402 continues to collect mail (stage 1260) until such time as it is triggered. It is also possible to manually fill and empty cells 402, should a malfunction occur with one of transport sorting 408, transport packaging 410, or purging 416 systems. If transport sorting 408, transport packaging 410, or purging system 416 fails to activate, the failed system communicates with control unit 112 and identifies the problem to an operator watching monitor 112*a*. For example, detectors 409,418 in communication with control unit 112 identify the location of the problem to the operator on monitor 112*a*.

Control unit 112 incorporates fault and fault override logic (not shown). If sorting and packaging system 100, 200 detects a fault, control unit 112 will try to redirect mail and identify the fault. The system will continue to run and operators will be notified of the fault via control unit monitor 112*a*. If a particular cell 402 has a problem, control unit 112 can identify that cell 402 as faulty and reassign that cell's address to another cell 402 and continue to process mail. If the fault results in a shut down, mail jam, or lost mailpiece, control unit 112 will identify the fault type and area of the fault on monitor 112*a*. If the problem cannot be resolved, cell 402 can be manually emptied or filled, or mail manually packaged or delivered to tray 1102 bound for a local post office.

Optionally, if circulars are being sent to various addresses, circular system 316 (FIG. 3) inserts circulars into the mailstream between mail for two different addresses at stage 1263 after cells 402 are purged and prior to packaging at packaging unit 426. If no circulars are sent on a particular day to a particular zip code, mailpieces 412, 414 simply continue to packaging without the insertion of circulars (stage 1264).

At stage 1265, mail for a particular address is packaged by packaging system 304 (FIG. 3). Packaging system 304 conveys mail from cell 402 on transport packaging system 410 (FIG. 4), faces and edges the mail so it is aligned for packaging by packaging unit 426, and contains it in a package 900, such as a band 902 or a bag 1000, as shown in FIGS. 9 and 10. If multiple cells exist for one address, for example due to cell overflow, packaging system 304, in conjunction with control unit 112, merges the mail purged from primary cell 402 and overflow cell(s) 402*a* prior to packaging by packaging unit 426.

Each package 900 is then conveyed, in delivery sequence, by delivery system 308 to containers or trays 1102 destined for particular post offices (stage 1268). Packages 900 do not have to be used in the sorting and packaging system and method, but the use of packages 900 has been demonstrated to increase the efficiency of postal carriers in delivering mail on the street.

After packaging and prior to delivery, at stage 1267, dividers 1106 may be inserted into the stream of mail packages on delivery transport system 308 by divider system 306 (FIG. 3). For example, dividers 1106 may be inserted between mail for NDCBUs on a mail route, as previously discussed with respect to FIG. 11. Directed by control unit 112, divider system 306 of SPLF SPS 110 would insert divider 1106 at particular locations (stage 1266), such as before package 900*f* destined for mailbox 6, the first mailbox of the second NDCBU in FIG. 11*a*. The postal carrier then can easily pull from tray 1102 the mail for the first NDCBU on his route, and because the mail is already packaged and in sequential order, he can quickly insert five mail packages 900*a*–900*e* into boxes 1–5 of the first NDCBU, where each package 900 is separated from those for the other 4 boxes by band 902. It is possible for the postal carrier to remove packaging 900 before placing the mail in the each of the mailboxes, although typically this process is time-consuming and is not done.

Once mail 412, 414 is transported to containers such as trays 1102 (FIG. 11*a*) in delivery order by delivery system 308, trays 1102 are conveyed to mobile storage units 1108 (FIG. 11*b*) by mobile storage system 310. As trays are sequentially filled, mobile storage system 310 takes filled tray 1102*a* (e.g., stop 1–100 of route 1 in a particular zip code) and places it in mobile storage unit 1108 based on zip code, route, and stop number (stage 1270). As next tray 1102*b* is filled (e.g., stop 101–200 of route 1), mobile storage system 310 inserts tray 1102*b* in mobile storage unit 1108 next to first filled tray 1102*a*, and so on until mobile storage unit 1108 contains trays, in delivery order, for every route in a particular zip code. Once all trays 1102 for a zip code or zip codes are filled and stored, mobile storage unit 1108 is moved to a loading dock, and filled trays 1102 are loaded onto a truck for delivery to post offices (stage 1272), where postal carriers will pick up the trays for their routes and deliver the mail.

Figure 13A:
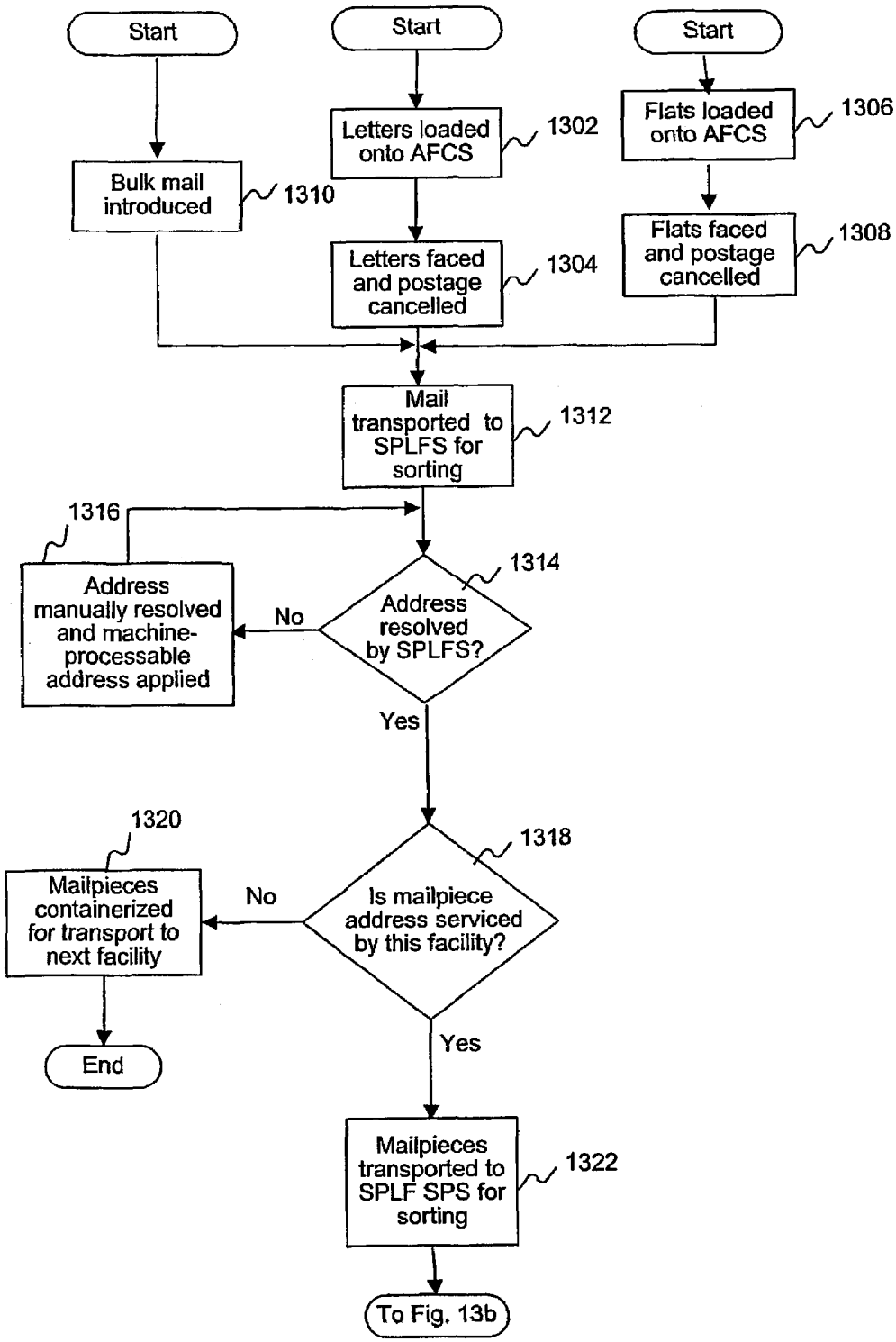
FIGS. 13*a* and 13*b* illustrate an exemplary flowchart of the sorting and packaging method used by the sorting and packaging system illustrated in FIG. 2, consistent with the present invention.
Figure 13B:
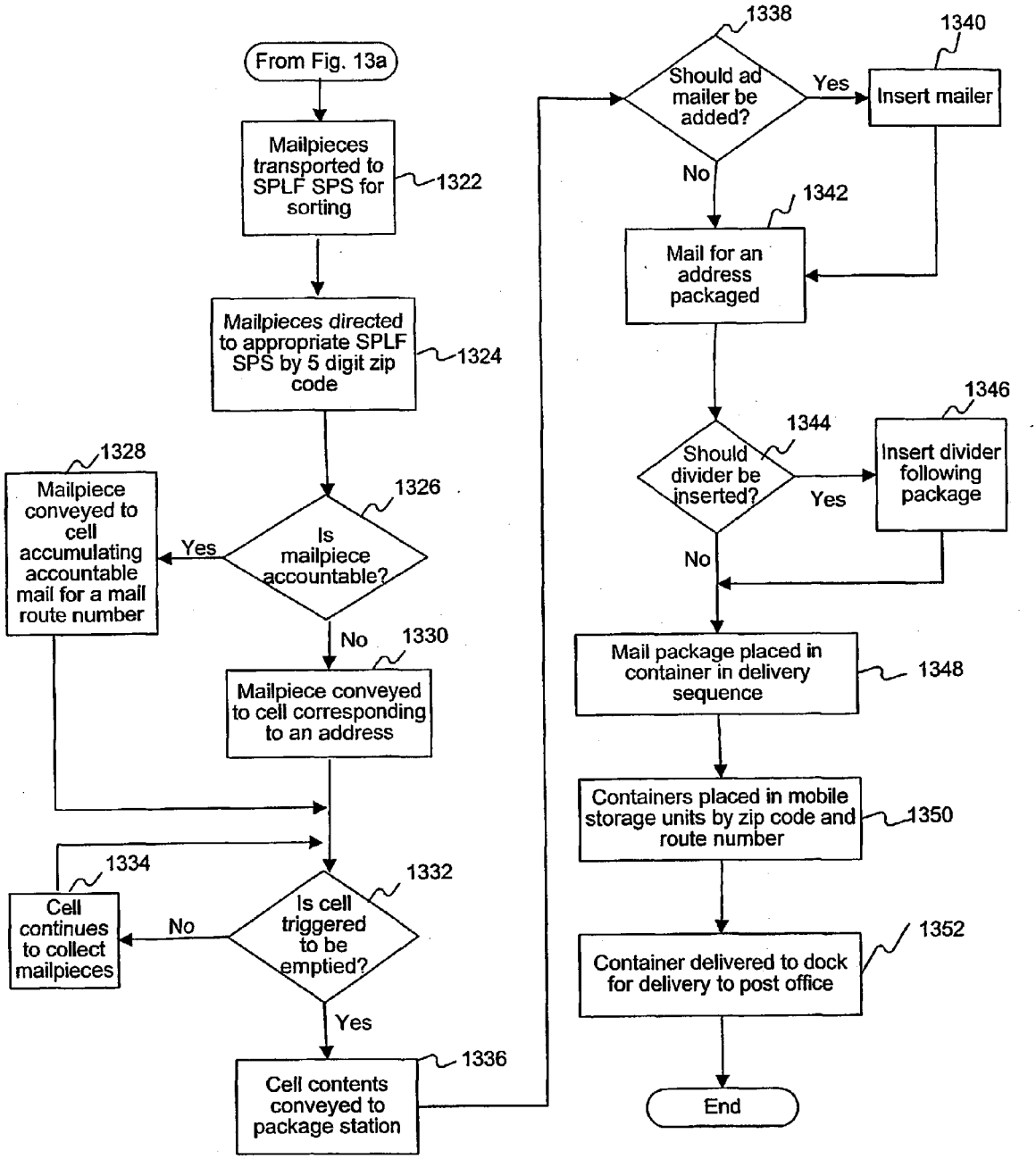

FIGS. 13*a* and 13*b* illustrate an exemplary flowchart of the sorting and packaging method used by sorting and packaging system 200 illustrated in FIG. 2. This embodiment of sorting and packaging method differs from that in FIGS. 12*a* and 12*b* in that it is even more automated because both letters and flats are automatically sorted on the same equipment simultaneously.

In stage 1302, letters are loaded onto AFCSs 102 (FIG. 2) for facing and canceling at stage 1304. Simultaneously, flats are loaded onto another AFCS 102 (stage 1306) and are faced and cancelled (stage 1308), and bulk mail is introduced into the mailstream (stage 1310). Letter, bulk, and flat mail are transported to a Single Pass Letter and Flat Sorter ("SPLFS") 204 for sorting (stage 1312).

If the address is not resolved by SPLFS 204 (FIG. 2) because SPLFS 204 is unable to scan and interpret the address (stage 1314) due to the color of the ink, the font, etc., the address is manually resolved and a machine-processable address is applied (stage 1316). If SPLFS 204 resolves the address, the address and/or bar code information is stored by control unit 112 in processor 112*c* (FIG. 2), and a bar code is sprayed or printed on the mailpiece if one is not already present. SPLFS 204, in conjunction with control unit 112, determines whether the address on the mailpiece is "serviced" by the postal facility currently sorting the mailpiece (stage 1318), as previously described in more detail for a letter with respect to stage 1218.

If the mailpiece is not to be delivered by a post office serviced by the processing facility presently sorting the mailpiece, the mailpiece is sent to a container for transport to another postal facility (stage 1320). If the mailpiece is serviced by the processing facility presently sorting the mailpiece, it is transported to the SPLF SPS 110 ("Single Pass Letter and Flat Sorting and Packaging System") by transport sorting system 410 for additional sorting and packaging for delivery to a specific post office, route, and address. Note that unlike sorting and packaging method illustrated in FIG. 12*a* at stage 1246, no combining station 108 (FIG. 1) is needed for the method described with respect to FIG. 13*a* because regular, bulk, and flat mailpieces are initially sorted together on the same equipment, and therefore do not need to be combined before transport to SPLF SPS 110.

The method associated with SPLF SPS 110 of sorting and packaging system 200 (FIG. 2) consistent with the present invention is depicted in FIG. 13*b*, which is a continuation of the flow from FIG. 13*a*. The remaining stages 1324 to 1352 of this sorting and packaging method duplicate stages 1248 to 1272 described with respect to system 100 (FIG. 1) and FIG. 12*b*. A duplicative description has been foregone, and it is understood that the same method described above for stages 1248 to 1272 is used for stages 1322 to 1352.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A sorting and packaging system, comprising:
an induction and scanning system;
a single pass sorting and packaging system for automatically sorting a plurality of mailpieces based on a single scan by the induction and scanning system, the single pass sorting and packaging system comprising:
at least one cell rack connected to the induction and scanning system by a transport sorting system and comprising a plurality of cells and a purging system;
at least one packaging system connected to the cell rack and comprising a transport packaging system and a packaging unit; and
at least one delivery system connected to the at least one packaging system; and
a control unit connected to and controlling the induction and scanning system and the single pass sorting and packaging system.

2. The sorting and packaging system of claim 1, wherein the single pass sorting and packaging system automatically sorts a plurality of letters based on a single scan by the induction and scanning system.

3. The sorting and packaging system of claim 2, wherein the single pass sorting and packaging system automatically sorts a plurality of flats based on a single scan by the induction and scanning system.

4. The sorting and packaging system of claim 3, wherein the single pass sorting and packaging system automatically sorts a plurality of parcels and bulk mail based on a single scan by the induction and scanning system.

5. The sorting and packaging system of claim 1, further comprising a combining station.

6. The sorting and packaging system of claim 5, wherein the combining station combines a plurality of letters with a plurality of flats.

7. The sorting and packaging system of claim 5, wherein the combining station combines a plurality of letters and a plurality of flats with a plurality of parcels and bulk mail.

8. The sorting and packaging system of claim 1, further comprising a plurality of single pass sorting and packaging systems and a director operable to direct the plurality of mailpieces to a predetermined single pass sorting and packaging system.

9. The sorting and packaging system of claim 1, wherein the induction and scanning system comprises at least one facer connected to at least one scanner.

10. The sorting and packaging system of claim 9, wherein the at least one facer is an Automatic Facer Canceller System.

11. The sorting and packaging system of claim 9, wherein the at least one scanner has at least one reader.

12. The sorting and packaging system of claim 9, wherein the at least one scanner is an Optical Character Reader.

13. The sorting and packaging system of claim 12, wherein the at least one Optical Character Reader comprises a first Optical Character Reader connected to a second Optical Character Reader.

14. The sorting and packaging system of claim 9, wherein the at least one scanner is a wide area bar code reader.

15. The sorting and packaging system of claim 9, wherein the at least one scanner is a wide field of view camera.

16. The sorting and packaging system of claim 1, wherein the scanning and induction system further comprises a name recognition system.

17. The sorting and packaging system of claim 1, wherein the transport sorting system has a plurality of detectors in communication with the control unit operable to detect malfunctions of the sorting and packaging system.

18. The sorting and packaging system of claim 17, wherein the control unit is operable to divert the plurality of mailpieces from a malfunctioning cell to a functioning cell.

19. The sorting and packaging system of claim 1, wherein the transport sorting system inserts a mailpiece into a cell corresponding to an address on the mailpiece.

20. The sorting and packaging system of claim 19, wherein the transport sorting system comprises a plurality of wedge-shaped conveyers each located above a corresponding cell.

21. The sorting and packaging system of claim 20, wherein the plurality of wedge-shaped conveyers are individually triggered by the control unit to discharge the plurality of mailpieces into the corresponding cell.

22. The sorting and packaging system of claim 21, wherein the plurality of mailpieces lie horizontally on a bottom of the corresponding cell.

23. The sorting and packaging system of claim 21, wherein a wedge-shaped conveyer comprises a series of conveyer belts.

24. The sorting and packaging system of claim 19, wherein the transport sorting system comprises a plurality of adjacent conveyer belts located above the plurality of cells, and an end of a conveyer belt is located above a corresponding cell.

25. The sorting and packaging system of claim 24, wherein a conveyer belt is individually triggered by the control unit to lower an end into a cell to discharge the plurality of mailpieces into the corresponding cell.

26. The sorting and packaging system of claim 25, wherein the plurality of mailpieces lie horizontally on a bottom of the corresponding cell.

27. The sorting and packaging system of claim 1, wherein the cell rack is formed with at least one level of adjacent cells.

28. The sorting and packaging system of claim 27, wherein the cell rack is formed with a plurality of proximate levels of adjacent cells.

29. The sorting and packaging system of claim 27, wherein a second level of adjacent cells is located above a first level of adjacent cells.

30. The sorting and packaging system of claim 27, further comprising a diverter operable to direct the plurality of mailpieces to a predetermined row of the cell rack.

31. The sorting and packaging system of claim 1, wherein a cell of the plurality of cells corresponds to a predetermined address.

32. The sorting and packaging system of claim 31, wherein the cell that corresponds to a predetermined address having a large volume of mail that is deeper than other cells.

33. The sorting and packaging system of claim 31, wherein the cell comprises a primary cell for the predetermined address.

34. The sorting and packaging system of claim 31, wherein the cell comprises an overflow cell for the predetermined address.

35. The sorting and packaging system of claim 34, wherein the overflow cell has an indicator indicating a link to a corresponding primary cell.

36. The sorting and packaging system of claim 1, wherein a cell of the plurality of cells corresponds to accountable mail for a predetermined postal route.

37. The sorting and packaging system of claim 36, wherein the control unit stores accountable information and sends accountable mail to the cell and creates a manifest of accountable mail for the predetermined postal route.

38. The sorting and packaging system of claim 1, wherein a cell of the plurality of cells comprises a first side wall, a second side wall, a front panel, and a cell bottom.

39. The sorting and packaging system of claim 38, wherein the cell shares a side wall with a adjacent cell.

40. The sorting and packaging system of claim 38, wherein the front panel contains a label.

41. The sorting and packaging system of claim 40, wherein the label identifies an address.

42. The sorting and packaging system of claim 40, wherein the label identifies a cell's contents.

43. The sorting and packaging system of claim 38, wherein the front panel of the cell is a partial front panel leaving an opening between a top of the front panel and a bottom of the transport sorting system.

44. The sorting and packaging system of claim 38, wherein the front panel of the cell is a full front panel having at least one hinge attaching the full front panel to a side wall and is operable to be opened.

45. The sorting and packaging system of claim 38, wherein the front panel of the cell comprises a full front panel having at least one hinge attaching the full front panel to the cell bottom and is operable to open.

46. The sorting and packaging system of claim 1, wherein a cell of the plurality of cells comprises a first side wall, a second side wall, and a cell bottom.

47. The sorting and packaging system of claim 46, wherein the cell has a label located adjacent to and below the cell bottom.

48. The sorting and packaging system of claim 47, wherein the label identifies an address and a cell's contents.

49. The sorting and packaging system of claim 1, wherein the cell has a sensor in communication with the control unit that is operable to indicate a full cell to the control unit.

50. The sorting and packaging system of claim 49, wherein the control unit is operable to divert the plurality of mailpiece from the full cell to a corresponding overflow cell that is empty.

51. The sorting and packaging system of claim 50, wherein the full cell includes an first indicator for indicating a location in the cell rack of the corresponding overflow cell and the corresponding overflow cell includes an second indicator for indicating a location in the cell rack of the full cell.

52. The sorting and packaging system of claim 49, wherein the overflow cell has a first purging system and the full cell has a second purging system, and wherein the first purging system of the overflow cell and the second purging system of the full cell are triggered by the control unit so that the plurality of mailpieces from the full cell and the overflow cell merge before the packaging unit.

53. The sorting and packaging system of claim 1, wherein each cell of the plurality of cells has the purging system in communication with the control unit and operable to remove mailpieces from the cell.

54. The sorting and packaging system of claim 53, wherein the purging system comprises a cell bottom.

55. The sorting and packaging system of claim 53, wherein the purging system comprises a conveyer belt.

56. The sorting and packaging system of claim 53, wherein the purging system comprises a plank operable to rise at a front end of the cell by activation of a solenoid.

57. The sorting and packaging system of claim 53, wherein the purging system comprises a plank operable to hydraulically rise at a front end of the cell.

58. The sorting and packaging system of claim 53, wherein the purging system comprises a plank operable to electrically rise at a front end of the cell.

59. The sorting and packaging system of claim 53, wherein the purging system comprises a plank operable to pneumatically rise at a front end of the cell.

60. The sorting and packaging system of claim 53, wherein the purging system may be triggered by the control unit to empty the cell.

61. The sorting and packaging system of claim 1, wherein the transport packaging system comprises a transport mechanism operable to convey the mailpieces from the purging system to the packaging unit.

62. The sorting and packaging system of claim 61, wherein the transport packaging system comprises at least one conveyer belt.

63. The sorting and packaging system of claim 61, wherein the transport packaging system is level with and perpendicular to the purging system.

64. The sorting and packaging system of claim 53, wherein the transport packaging system is located behind and adjacent to cell rack.

65. The sorting and packaging system of claim 1, wherein the packaging unit is operable to package at least one mailpiece addressed to a specific address into a package.

66. The sorting and packaging system of claim 65, wherein the package comprises a band removeably surrounding the at least one mailpiece addressed to a specific address.

67. The sorting and packaging system of claim 65, wherein the package comprises a bag removeably surrounding the at least one mailpiece addressed to a specific address.

68. The sorting and packaging system of claim 67, wherein the bag is transparent.

69. The sorting and packaging system of claim 67, wherein the bag comprises a transparent window through which an address may be read.

70. The sorting and packaging system of claim 67, wherein the bag comprises an advertisement on a first side of the bag.

71. The sorting and packaging system of claim 67, wherein the bag comprises a delivery date on a second side of the bag.

72. The sorting and packaging system of claim 67, wherein the bag comprises a logo on a second side of the bag.

73. The sorting and packaging system of claim 1, further comprising a circular system operable to insert a circular into the transport packaging system.

74. The sorting and packaging system of claim 73, wherein the circular system is located between the cell rack and the packaging unit.

75. The sorting and packaging system of claim 73, wherein the circular system is located between the scanning and induction system and a combining station.

76. The sorting and packaging system of claim 73, wherein the circular system is located between the scanning and induction system and a director.

77. The sorting and packaging system of claim 73, wherein the circular system is located between the director and the cell rack.

78. The sorting and packaging system of claim 1, wherein the delivery system is operable to transport mailpieces in delivery sequence from the packaging unit to a plurality of trays destined for local post offices.

79. The sorting and packaging system of claim 78, wherein the delivery system extends from the packaging unit to an area adjacent to a loading dock at a postal facility.

80. The sorting and packaging system of claim 78, further comprising a mobile storage system operable to store and transport the plurality of trays in delivery sequence to at least one mobile storage unit.

81. The sorting and packaging system of claim 78, wherein the control unit indicates when a first tray is full, directs a mobile storage system to transport the tray to a mobile storage unit, and directs the delivery system to load a second tray.

82. The sorting and packaging system of claim 81, wherein the control unit prints and applies a label to the first tray indicating information about the first tray.

83. The sorting and packaging system of claim 78, wherein the mobile storage unit is operable to transport the plurality of trays to the loading dock.

84. The sorting and packaging system of claim 83, wherein the mobile storage unit has a plurality of cells to store the plurality of trays.

85. The sorting and packaging system of claim 1, wherein the control unit comprises a display, a keyboard, and a processor.

86. The sorting and packaging system of claim 1, further comprising a divider system located between the packaging unit and the delivery system, operable to insert a divider between a first package and a second package at a predetermined place when triggered by the control unit.

87. The sorting and packaging system of claim 1, located in a first postal facility and further comprising a container located between the induction and scanning system and the single pass sorting and packaging system, wherein the container is operable to collect a plurality of mailpieces destined for a second postal facility.

88. The sorting and packaging system of claim 1, further comprising a diverter component in communication with the control unit and operable to divert the plurality of mailpieces to a predetermined level of the cell rack.

89. A sorting and packaging system located in a first postal facility, comprising:

an induction and scanning system;

a single pass sorting and packaging system for automatically sorting a plurality of mailpieces based on a single scan by the induction and sorting system, the single pass sorting and packaging system comprising:

a cell rack connected to the induction and scanning system by a transport sorting system and comprising a plurality of cells and a purging system;

a packaging system connected to the cell rack and comprising a transport packaging system and a packaging unit; and a delivery system connected to the packaging system;

a container located between the induction and scanning system and the single pass sorting and packaging system for receiving a plurality of mailpieces destined for a second postal facility, and a control unit connected to and controlling the induction and scanning system and the single pass sorting and packaging system.

90. A method of sorting and packaging a plurality of mailpieces, comprising:

automatically facing and scanning the mailpieces;

automatically sorting and packaging the mailpieces into a plurality of packages based on a single scan by an induction and sorting system;

automatically delivering the packages to a plurality of trays located adjacent to a loading dock;

connecting and controlling the induction and scanning system and a single pass sorting and packaging system with a control unit, wherein the single pass sorting and packaging system comprises a cell rack, a packaging system, and a delivery system; and communicating and processing information for and between the induction and scanning system and the single pass sorting and packaging system with the control unit.

91. The method of sorting and packaging a plurality of mailpieces of claim 90, further comprising inserting a divider at a predetermined location between a first package and a second package prior to delivery to the plurality of trays.

92. The method of sorting and packaging a plurality of mailpieces of claim 90, further comprising diverting the plurality of mailpieces to a predetermined level of the cell rack.

93. The method of sorting and packaging a plurality of mailpieces of claim 90, further comprising containerizing a portion of the plurality of mailpieces at a first postal facility that are destined for a second postal facility.

* * * * *

UNITED STATES PATENT AND TRADEMARK OFFICE

CERTIFICATE OF CORRECTION

PATENT NO. : 7,060,926 B2
APPLICATION NO. : 10/312402
DATED : June 13, 2006
INVENTOR(S) : Dean S. Edmonds It is certified that error appears in the above-identified patent and that said Letters Patent is hereby corrected as shown below:

In claim 32, column 21, line 59, “having a large volume” should read --a large volume--.

In claim 39, column 22, line 15, “a adjacent” should read --an adjacent--.

In claim 50, column 22, line 47, “mailpiece” should read --mailpieces--.

In claim 51, column 22, line 50, “an first” should read --a first--.

In claim 51, column 22, line 52, “an second” should read --a second--.

In claim 64, column 23, line 30, “to cell” should read --to the cell--.

Signed and Sealed this

Twelfth Day of September, 2006

JON W. DUDAS
*Director of the United States Patent and Trademark Office*